US007069852B2

(12) United States Patent
Zindl et al.

(10) Patent No.: US 7,069,852 B2
(45) Date of Patent: Jul. 4, 2006

(54) STAMP AND DEVICE FOR RECEIVING AN INKING PAD

(75) Inventors: Peter Zindl, Obertraun (AT); Manfred Haiberger, Piberbach (AT)

(73) Assignee: Trodat GmbH, Wels (AT)

( * ) Notice: Subject to any disclaimer, the term of this patent is extended or adjusted under 35 U.S.C. 154(b) by 0 days.

(21) Appl. No.: 10/514,618

(22) PCT Filed: May 14, 2003

(86) PCT No.: PCT/AT03/00138

§ 371 (c)(1),
(2), (4) Date: Nov. 16, 2004

(87) PCT Pub. No.: WO03/099572

PCT Pub. Date: Dec. 4, 2003

(65) Prior Publication Data

US 2005/0145127 A1 Jul. 7, 2005

(30) Foreign Application Priority Data

May 27, 2002 (AT) ..... A 805/2002
Jan. 17, 2003 (AT) ..... A 57/2003

(51) Int. Cl.
*B41K 1/42* (2006.01)
*B41K 1/40* (2006.01)

(52) U.S. Cl. ..... 101/334; 101/405; 101/104

(58) Field of Classification Search ..... 101/327, 101/333, 405, 406, 103, 368, 334, 104
See application file for complete search history.

(56) References Cited

U.S. PATENT DOCUMENTS

| | | | | |
|---|---|---|---|---|
| 454,499 | A * | 6/1891 | Ryer | 101/334 |
| 1,085,489 | A * | 1/1914 | Rushworth | 101/334 |
| 5,517,916 | A | 5/1996 | Dour et al. | 101/334 |
| 5,649,485 | A * | 7/1997 | Dour et al. | 101/334 |
| 5,850,787 | A | 12/1998 | Pichler | 101/105 |
| 6,877,426 | B1 * | 4/2005 | Huang | 101/334 |

FOREIGN PATENT DOCUMENTS

| | | |
|---|---|---|
| DE | 1 008 756 | 5/1957 |
| WO | WO 01/83227 A1 | 11/2001 |

* cited by examiner

*Primary Examiner*—Leslie J. Evanisko
(74) *Attorney, Agent, or Firm*—Collard & Roe, P.C.

(57) ABSTRACT

A device comprising: a holding fixture (23) for a carrier device (5) of a stamp pad (40, in particular for a stamp (1) with a pivotable printing plate carrier (8), in which a shaft (20) with an approximately rectangular cross section is arranged. The carrier device (5) for the stamp pad (4) is mounted therein, and if necessary can be pushed out relative to the shaft (20). A holding device (31) positions the carrier device (5) relative to the guide track of the shaft (20) in its position of work or use (33). A further holding device (32) enables the carrier device (5) together with the stamp pad (4) to be positioned in a replacement or maintenance position (34) remote from the position of work or use (33), and to be restrictable relative to the shaft (20) on how far it can be pushed out. The further holding device (32) can, if necessary, be deactivated by applying increased displacement forces on the carrier device (5).

33 Claims, 13 Drawing Sheets

STAMP AND DEVICE FOR RECEIVING AN INKING PAD

CROSS REFERENCE TO RELATED APPLICATIONS

Applicants claim priority under 35 U.S.C. §119 of Austrian Application Nos. A 805/2002 and A 57/2003, filed May 27, 2002 and Jan. 17, 2003, respectfully. Applicants also claim priority under 35 U.S.C. §365 of PCT/AT03/00138 filed May 14, 2003. The international application under PCT article 21(2) was not published in English.

BACKGROUND OF THE INVENTION

1. Field of the Invention

The invention relates to a device comprising a holding fixture for a carrier device of a stamp pad, as well as a stamp.

2. Description of the Prior Art

Various holding fixtures for stamp pads or carrier devices are already known, for example from the Applicant's WO 01/83227 A1. A holding fixture of this kind is positioned in a lower part of a multiple part stamp housing. The lower part of the stamp housing is designed in the shape of a hollow prism and has a rectangular cross section. In the direction of the longitudinal axis of the hollow prism on both narrow sides of the lower part, guide tracks running parallel to the longitudinal axis are arranged for receiving the guide elements of the upper part. The upper part is movably coupled by a lever mechanism to a printing plate carrier and pivotably guided via sliding tracks on both inner sides of the narrow sides of the lower part. The upper part of the housing which is movably connected to the printing plate carrier is mounted in a stop-defined position of rest by means of a spring arranged between the housing and the lower part, in such a way that the guide elements of the upper part are located in the end part of the guide track of the lower part facing the upper part. In this position of rest the printing plate carrier lies against the stamp pad, which is slidably mounted in an end side of the lower part facing the upper part, in particular in a guide track for a carrier device of the stamp pad perpendicular to the longitudinal axis of the hollow prism. In order to replace the stamp pad the printing plate carrier is moved and if necessary locked in the direction of the end face of the hollow prism opposite the stamp pad. Thereupon the stamp pad can be removed perpendicular to the longitudinal axis or with the carrier device pushed along the guide track so far that the stamp pad can be exchanged or the carrier device can be removed from the lower part together with the stamp pad. In order to secure the carrier device of the stamp pad in a position of use a securing device is provided between the lower part and the carrier device which can be designed to have elastically self-restoring locking elements.

Furthermore, it is already known for a stamp to have a locking projection cooperating with roughened sections between the carrier device for the stamp pad and the lower part of the housing, in order to achieve a braking effect upon removing or inserting the carrier device and to limit the speed at which the carrier device can be adjusted relative to the housing.

These known stamps have proved to be very effective in practice. However, when removing the stamp pad from the housing it has not been possible in some cases to prevent the user getting his hands covered in ink.

SUMMARY OF THE INVENTION

The objective of the present invention is to structure the arrangement and/or design of the stamp pad and its carrier device in such a way that it is possible to replace the stamp pad without the risk or with a low risk of the user or the surroundings getting covered in ink.

This objective of the invention is achieved with a device comprising a holding fixture for a carrier device of a stamp pad, a shaft with an approximately rectangular cross section arranged in the holding fixture, and the carrier being mounted therein so as to be movable out relative to the shaft, and a holding device which holds the carrier device relative to a guide track of the shaft in a position of work or use. The carrier device is arranged on an outer wall Part of a housing of the holding fixture forming the shaft and the outer wall part is securable and adjustable relative to the housing by means of a guiding or fixing element.

It is advantageous in this case that the stamp pad with a part of the stamp, in particular a housing part, can be moved into a position in which the stamp pad can be easily exchanged and handled safely. In particular, it is not necessary to hold the stamp pad or the carrier device directly to remove it from the stamp or from its housing and in this way the user can avoid the unpleasantness or irritation of getting covered in ink. In addition, the number of components can be reduced as the mount for the stamp pad can be formed in one piece on an otherwise necessary component, in particular a wall of the stamp or its housing-like mounting device.

By providing a coupling device between the carrier device and the outer wall part, which can be operated without tools, it is possible to continue to use the flat outer wall part of the stamp housing and only replace the stamp pad together with the carrier device.

The advantageous design according to claim 3 produces a practical, extended grip for the replacement or examination of the stamp pad.

The objective can also be achieved with a device comprising a holding fixture for a carrier device of a stamp pad, a shaft with a rectangular cross section arranged in the holding fixture, and a holding device arranged between two end face regions of the shaft, the shaft forming a guide track and mount for the carrier device, which can be inserted and removed therefrom, the holding device positioning the carrier device relative to the guide track of the shaft in its position of work or use. At least one additional holding device enables the carrier device together with the stamp pad to be held positioned in a replacement or maintenance position distant from the position of work or use, or a pushing out movement of the carrier device can be delimited relative to the shaft. This additional holding device can be deactivated by applying increased adjusting forces on the carrier device. The holding devices are locking or stop elements spaced apart from each other in the direction of a guide length of the shaft on inner surfaces of the shaft, or locking or stop elements in end face regions of the shaft, or locking or stop elements on outer surfaces of the carrier device. At least one of the locking or stop elements is elastically pliable and self-restoring due to properties inherent in a plastic material of projections or indentations.

In this solution it is advantageous that the stamp pad and its carrier device are no longer secured or positioned only in the working position for inking or re-inking the printing plate carrier, but via the movement for removal are also restricted and/or held at an additional position. In this way the user, when changing or refilling the stamp pad, is able to hold the stamp pad and its carrier device, after it has already been pushed along part of the length of the guide track and projects out of the lower part of the housing, so that he does not get dirty and the risk of this is minimised. In addition, in case the first securing or holding device for fixing the working position of the stamp pad and its carrier device is unlocked unintentionally, the stamp pad and its carrier device are prevented from falling out accidentally.

The carrier device for the stamp pad does not need to be held directly in order to carry out a visual examination or replacement thereof if the carrier device has an adjustably mounted grip.

A completely functional and yet economical moving connection between the carrier device and the grip is obtained if the grip is pivotably connected to the carrier device by a film-hinge.

The stamp pad can be secured and even locked in a simple manner to prevent it falling out or being pushed unintentionally out of the holding shaft if the grip can be adjusted between an active position, in which the effect of force on the carrier device is facilitated, and an inactive position in which the carrier device is locked or prevented from moving relative to the shaft.

Another objective of the invention is obtained with a stamp of the self-inking type, which comprises a lower part to be placed on a surface to be stamped, an upper part which is displaceable relative to the lower part against a restoring force of a spring, a turning and displacement mechanism movably coupled with the upper part for a stamp elate arranged on the lower part in order to move the lower part under forced turning and translatory movement between a stamp and the surface to be stamped. The stamp pad is mounted at least partially in a comparatively stable frame or cap-shaped carrier device secured by a holding device in a position of work or use. A grip on the carrier device enables it to be moved at least from the secured position of work or use into a replacement or maintenance position or at least into a position uncoupled from the holding device. The grip is adjustably mounted and can be moved between a position of rest and an active or working position.

The advantage of this design is that the stamp pad and its carrier device, which is often also covered in ink, need not be held directly or touched by the user in order to carry out a check or replace the stamp pad. The risk of the user getting his fingers or clothing dirty can be reduced significantly by means of this mechanical manipulation aid on the stamp of the invention. Furthermore, it can be made optically clear that the grip on the stamp is for moving or displacing the stamp pad, whereby the individual functions of the stamp are clarified and awkward or erroneous handling can be avoided as far as possible.

Preferably, the effect of force of the carrier device is facilitated in the active or working position and, in the position of rest of the grip, the relative mobility of the carrier device is restricted or blocked relative to the stamp. In this way even in the case of knocks, such as when the stamp falls to the floor, the stamp pad cannot fall out and nothing will get dirty, for example the floor.

If the grip is a one-piece tab formed on the carrier device which can be pivoted up about a horizontal pivot axis into position of work or use, a carelessly positioned grip is prevented from hindering the stamping process and the tab-like grip is prevented from being ripped off or damaged if the upper part is suddenly pressed down on the lower part.

A defined starting position or position of rest for the grip can be maintained simply if the grip is secured in its position of rest by a locking or snap device.

If a lower edge region of the upper part overlaps the carrier device either on a front or a back side, and the grip is formed on the upper part, the operating element of the stamp can be pulled over the pad holder, whereby in an advantageous manner a relatively large holding surface is created and the ergonomic operation of the stamp is improved.

The replacement or removal of a stamp pad can be made significantly easier by positioning the grip ready for use relative to the carrier device with an active securing device or at a defined relative position between the upper part and the lower part, as the stamp plate or the printing plate carrier does not touch the stamp pad and is thus not blocked relative to the holding shaft. The stamp can also be protected from damage as the stamp pad can be pressed out of the holding shaft without being blocked by the printing plate carrier via the grip in its position at the same height as the stamp pad or its carrier frame.

BRIEF DESCRIPTION OF THE DRAWING

The invention is explained in more detail in the following with reference to the embodiments illustrated in the drawings, in which.

DETAILED DESCRIPTION OF PREFERRED EMBODIMENTS

It should be established first of all that in the variously described embodiments the same parts are given the same reference numbers and the same component names, whereby the disclosures contained throughout the description can be applied analogously to the same parts with the same reference numbers and same component names. Furthermore, the details of position used in the description, such as e.g. top, bottom, side etc. relate to the Figure being described at the time, and if there is a change of position should be transferred accordingly to the new position. In addition, individual features or combinations of features from the different embodiments shown and described examples represent in themselves independent, inventive or inventive solutions.

Figure 2:
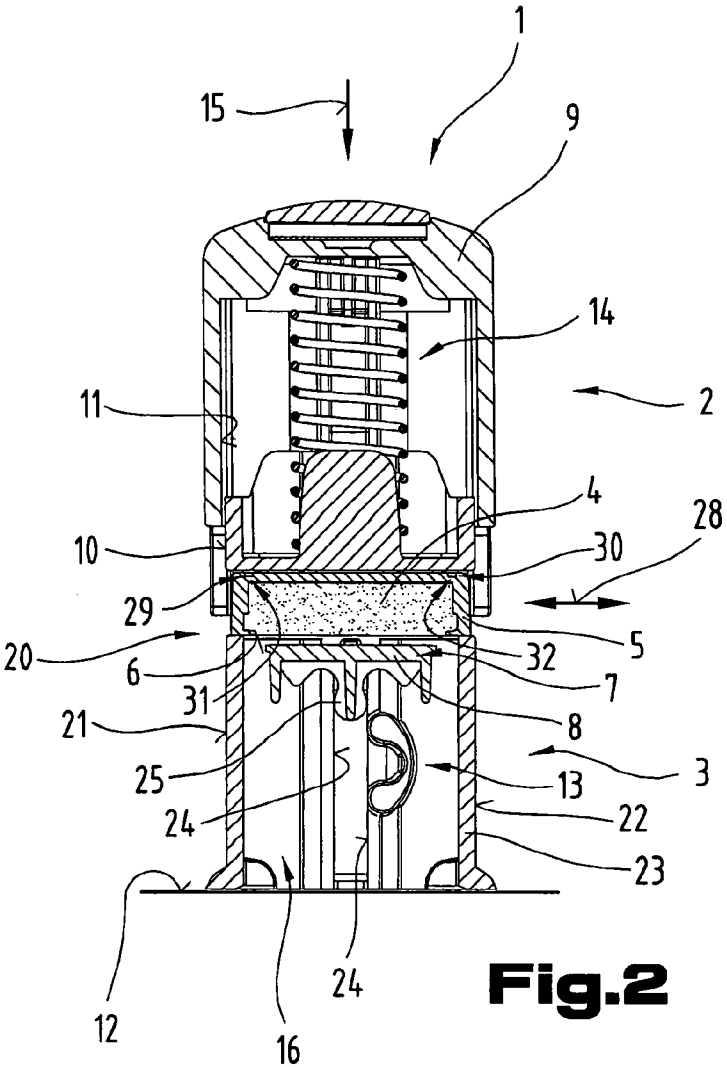
FIG. 2 shows the stamp according to FIG. 1 in cross section along the lines II—II of FIG. 1.
Figure 1:
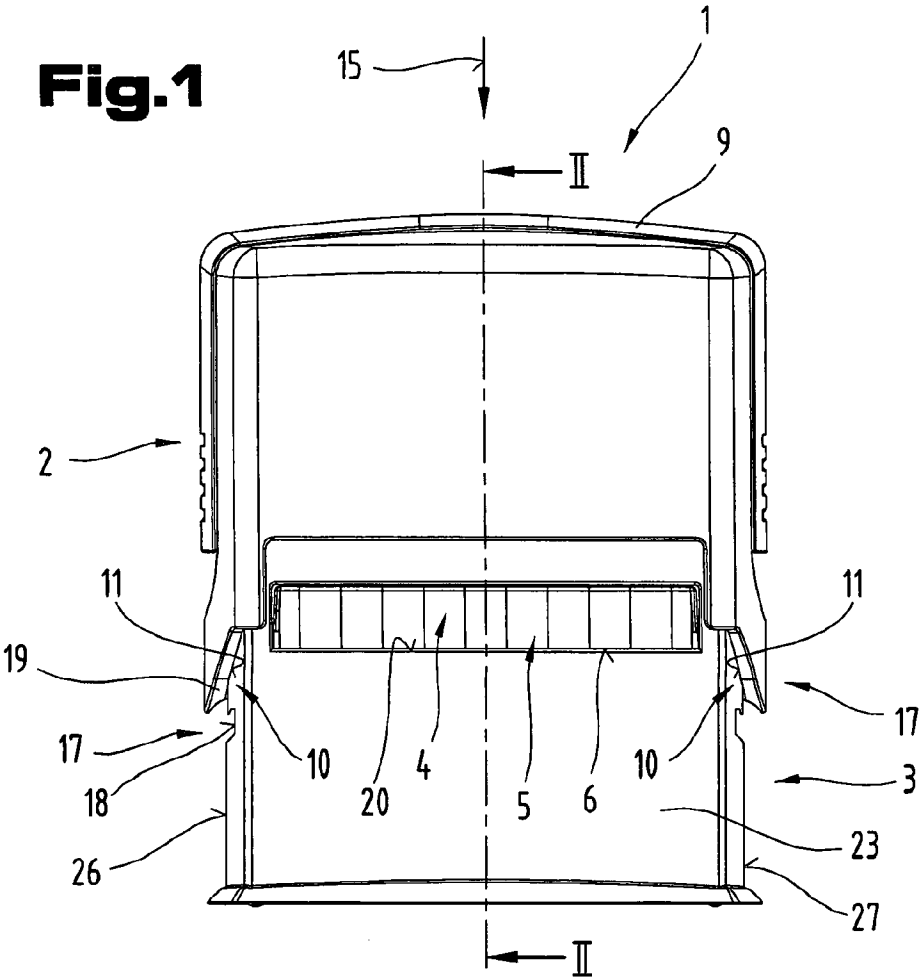
FIG. 1 shows a stamp designed according to the invention in side view in a simplified drawing with a stamp pad mounted displaceably in a lower part of the stamp housing in a guide track.
Figure 3:
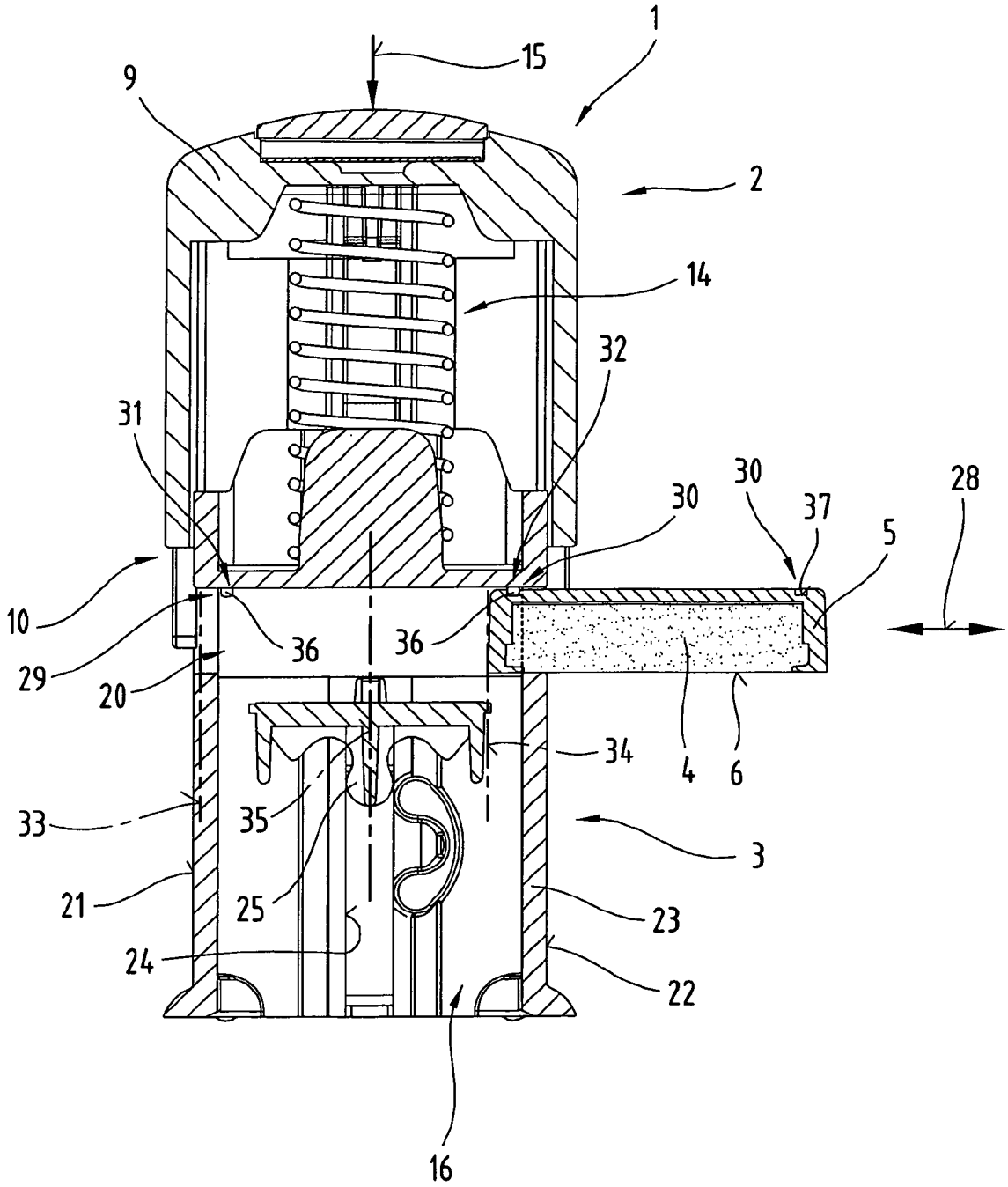
FIG. 3 shows the stamp according to FIGS. 1 and 2 in a pushed out position of the stamp pad and in a position which is stop or end-delimited by a holding device of the latter.

In FIGS. 1 to 3 a stamp 1 designed according to the invention is illustrated in simplified, schematic view.

Said stamp 1 is designed here as a so-called self-inking stamp in which the stamp surface is automatically refilled with printing or stamp colour, preferably ink. For this purpose a stamp pad 4 is arranged in the stamp 1 which essentially comprises an upper part 2 and a lower part 3. Said stamp pad 4 has sponge-like properties so that a specific supply of stamp ink may be stored and deposited over a longer period. In order to change the properties or the quality of the print that can be produced by the stamp 1 the stamp pad 4 is mounted in the stamp 1 in such as way that it can be replaced. Preferably, the stamp pad 4 is mounted in a frame or box-like carrier device 5 that is turned over or "standing on its head", and by means of the comparatively stable carrier device 5 is mounted in the lower part 3 of the stamp 1 and can be replaced if necessary. The carrier device 5 designed in the form of a mounting or holding element for the stamp pad 4 is thus delimited at the bottom by the ink-soaked stamp pad 4. The arrangement and alignment of the stamp pad 4 and an adjusting mechanism in the stamp 1 is hereby selected such that there is alternate contact between a stamp plate 7 adjustable relative to the lower part 3 with the characters or graphics to be stamped and the transfer of ink onto the surface to be stamped. Said stamp plate 7 can thus comprise a printing plate carrier 8 pivotable and adjustable inside the stamp 1 and a printing plate—not shown—having the desired graphics or desired characters. Alternatively, it is also possible to attach exchangeable or different graphics or fonts onto the printing plate carrier 8 as required. Of course, it is also possible to provide the stamp plate 7 directly with the desired characters, texts or graphics and to make the imprint unchangeable.

The upper part 2 can be in the form of a dome-shaped operating element 9, which is connected to the lower part 3 and in particular surrounds the upper edge of the lower part 3. The upper part 2 and the lower part 3 are thus telescopically adjustable relative to one another via a guide arrangement 10, 11. With such an adjustment of the upper part 2 relative to the lower part 3 by pressing down the operating element 9 the printing plate carrier 8 makes a translatory movement as well as a rotational movement, in particular a turning movement, and in this way is moved in the direction of a standing surface 12 of the stamp 1, which is usually in the form of a piece of paper to be stamped. For this purpose in the stamp 1 a turning and displacement mechanism 13, which is known from the prior art and is not described in more detail, is incorporated for the printing plate carrier 8. Said turning and displacement mechanism 13 thus produces a moving connection between the operating element 9 or the upper part 3 and the printing plate carrier 8, in such a way that the latter starting from its position shown in FIG. 2, in which it is in contact with the stamp pad 4, is moved into a lower position pivoted by 180°, in which it comes into contact with the material to be stamped and vice versa.

The operation of the stamp 1 is hereby performed against the force of a spring 14, preferably in the form of a compression spring. Said spring 14 causes an automatic restoring of the stamp 1 into the position of rest or starting position shown in FIGS. 1 and 2, in which the stamp plate 7 or the printing plate carrier 8 is in contact with the stamp pad 4 and exerts a defined pressure on the stamp pad 4. The stamp plate 7 is thus delimited translatorily by means of the turning and displacement mechanism 13 in the stamp 1 and is also rotationally delimited in a channel 16 in the lower part 3 running parallel to the operating direction—arrow 15—of the operating element 9. In particular there is a compulsory movement coupling between the operating element 9 and the stamp plate 7 or the printing plate carrier 8. Said channel 16 in this way—mainly depending on the shape of the stamp plate 7 or the printing plate carrier 8 can have an angular, for example rectangular or square or even an oval or round cross section.

In order to carry out a simplified replacement or simplified re-inking of the stamp pad 4 a securing device 17 is provided if necessary between the upper part 2 and the lower part 3 within the guide length of the guide arrangement 10, 11. Said securing device 17 permits the securing of the upper part 2 relative to the lower part 3 in an area between the starting position or position of rest shown in FIGS. 1 and 2 and the active position, in which the stamp plate 7 can produce an imprint on the standing surface 12. In particular, by means of this securing device 17 a necessary securing or temporary locking of the printing plate carrier 8 is made possible at a defined distance from the stamp pad 4. In this not shown, occupiable and retractable position, the printing plate carrier 8 is not in direct contact with the stamp pad 4, so that the stamp pad 4, preferably together with the frame-like carrier device 5, can be removed easily from the stamp 1 or at least pulled out of the latter.

Said securing device 17 in a intermediate position between the ink receiving position—FIG. 2—and an ink depositing position of the printing plate carrier 8 can be formed by corresponding indentations 18 and elevations 19 on the lower part 3 and/or on the upper part 2. By means of this, if necessary activatable and preferably automatically deactivatable securing device 17 the wetting of the printing plate carrier 8 or the stamp plate 7 with ink can be prevented from taking too long. In particular, by continually pressing down the operating element 9 in operating direction—arrow 15—the securing device 17 can be released automatically. This is made possible in a simple way by means of angled sections or hooks which can be biased relative to one another on the corresponding indentations 18 and elevations 19. A possible design for the indentations 18 and elevations 19 to achieve an automated or automatic deactivation of an activated securing device 17 is illustrated in FIG. 1.

If necessary it is also possible to have activation and an intentional or active deactivation of the securing device 17. In this way it is possible to prevent the operating element 9 being moved unintentionally or unexpectedly into the active or stamping working position. In this way for example during the transport of the stamp 1 there can no longer be unwanted stamping and the surrounding area or nearby objects cannot get covered in ink.

In this adopted locked or intermediate position determined by the securing device 17 the removal or withdrawal of the carrier device 5 with the stamp pad 4 from the stamp 1 is made straightforward, as the outwards or swivel movement of the stamp pad 4 together with its carrier device 5 is not hindered by the stamp plate 7 or the printing plate carrier 8.

As can best be seen from FIG. 2 the carrier device 5 for the stamp pad 4 is preferably mounted in the lower part 3 so as to be replaceable. For this in the upper edge region of the lower part 3 a shaft 20 is formed, in which the ink pad, in particular the carrier device 5 together with the stamp pad 4, can be exchanged or at least inserted and at least partly removed. Said shaft 20 thus forms a mount for the essentially cuboidal stamp pad 4 with the carrier device 5 partly surrounding the latter. Said shaft is thereby preferably—as illustrated in FIG. 2—designed as an opening which extends perpendicular to the longitudinal direction or perpendicular to the operating direction—arrow 15—of the stamp 1. In this way it is possible to push out the carrier device 5 with the stamp pad 4 starting from two opposite sides or wall surfaces of the stamp 1 from the lower part 3. In the working position shown in FIG. 2 the carrier device 5 of the stamp pad 4 engages essentially flush with opposite wall surfaces 21, 22 of the lower part 3. In this way it is ensured that the telescopic relative adjustment between the upper part 2 and the lower part 3 is not hindered and on the other hand a secure and stable mounting in the shaft 20 of the lower part 3 can be ensured.

The lower part 3 of the stamp 1 thus forms a housing-like mounting device 23, at least for the carrier device 5 of a soft elastic stamp pad 4, whereby in the end face region of the holding fixture 23 facing the operating element 9 the perpendicular shaft 20 is designed for the exchange of the carrier device 5. The end part of the hollow prismatic holding fixture 23 opposite the shaft 20 has a breakthrough or opening, the cross section of which corresponds at least to the size or the cross section of the printing plate or stamp plate 7.

The holding fixture 23 or the lower part 3 is thus made to be hollow or frame-like and at least mounts the carrier device 5 for the stamp pad 4. Preferably the holding fixture 23 is also used for guiding the stamp plate 7 or the printing plate carrier 8 inside the holding fixture 23 designed in the form of a frame or in the form of a hollow prism or drop shaft. Vertical guides 24 for axle stubs 25 of the printing plate carrier 8 are preferably arranged in the region of opposite narrow sides 26, 27 of the stamp 1 or the lower part 3 or the holding fixture 23 corresponding therewith.

In the case of a generic self-inking stamp in the embodiment described above or in a corresponding, equivalent version it is intended according to the invention that the ink pad, in particular the carrier device 5 with the stamp pad 4 mounted therein, does not fall out of the shaft 20 in an uncontrolled manner, when the working position or position of use of the stamp pad 4 is changed—for example in order to replace the stamp pad 4 alone or together with the carrier device 5 and to refill the latter. In this way the operator or peripheral objects are prevented from getting dirty. This can be achieved on the one hand in that in the shaft 20 for the replaceable or at least relatively adjustable mounting of the carrier device 5 for the stamp pad 4 at least two locking or stop elements 29, 30 spaced apart from on another in insertion and removal direction—according to arrow 28—are formed on the holding fixture 23 in the region around the shaft 20 or in the shaft 20 and/or on the carrier device 5 of the stamp pad 4, which form one first and at least one second holding device 31, 32 for the stamp pad 4 relative to the shaft 20 or the stamp 1 or relative to the holding fixture 23. In this way it is achieved that the carrier device 5 with the ink-soaked stamp pad 4 is positioned in at least two different positions or in one position, in particular in a position of work or use 33, and in at least one additional position is restricted from being removed from the shaft 20, whereby the end position or stop restriction can be removed or overcome if necessary, so that the stamp pad 4 can be removed completely together with the carrier device 5 from the stamp 1 or the holding fixture 23.

The first position secured by the locking or stop elements 29 of the first holding fixture 31 is thus defined by a position of work or use 33, as seen in FIG. 2. The other position spaced apart therefrom is defined by a replacement or maintenance position 34, in which the carrier device 5 projects over the lower part 3 or the holding fixture 23, however by means of at least one locking or stop element 29 to 30 the uncontrolled removal from the shaft 20 can be prevented. Only by means of the additional and knowing application of an increased removal force by the operator of the stamp 1 on the carrier device 5 can the holding or positioning force of the other or second locking or stop element 30 spaced apart from the first locking or stop element 29 can be overcome and the carrier device 5 removed completely together with the stamp pad 4 from the stamp 1. The stamp pad 4 can in the removed replacement or maintenance position 34 be re-filled with the appropriate ink and returned to the position of work or use 33, in that the operator exerts the corresponding amount of pressure on the carrier device 5. It is also possible to replace a used stamp pad 4 together with the carrier device 5 by using a carrier device 5 with a new stamp pad 4.

In the replacement or maintenance position 34 a portion of the carrier device 5 projects at least so far over the holding fixture 23 or over the lower part 3 of the stamp 1 that the carrier device 5 can be gripped securely by the user, without running the risk of sliding out or directly touching the ink-soaked stamp pad 4.

The locking or stop elements 29, 30 spaced apart from one another in insertion or removal direction—arrow 28—along the shaft 20 can thereby be designed to be identical and mirror symmetrical to a transverse plane 35 of the shaft 20. In this way the carrier device 5 can be pushed out from any wall surface 21 or 22 in the direction of the opposite wall surface 22 or 21. The locking or stop elements 29, 30 spaced apart from one another in guiding or removal direction of the carrier device 5 are preferably identical, but can of course also be constructed differently in order to secure the carrier device 5 and the stamp pad 4 in the position of work or use 33, and in a position spaced apart therefrom for removal or replacement or maintenance 34.

In the embodiment shown the mutually spaced apart locking or stop elements 29, 30 are in the form of projections 36 which project from at least one inner delimitation surface of the shaft 20. Of course, it is also possible to make projections 36 of this kind, which form locking noses for the secure positioning of the carrier device 5, close to the end regions or directly on the end regions of the shaft 20 and thereby design the projections 36 as locking lips, which project in the direction of the longitudinal middle axis of the shaft 20.

The mutually spaced apart locking or stop elements 29, 30 or holding devices 31, 32 can thus instead of the arrangement on the inner delimitation surfaces of the shaft 20 also be formed on the carrier device 5 for the stamp pad 4. It is also possible to design the mutually spaced apart locking or stop elements 29, 30 to produce the elastically secured position of work or use 33 and the replacement or maintenance position 32 in both the inner region or in the end face regions of the shaft 20 and on one of the surfaces of the carrier device 5. For this, mutually corresponding projections 36 and indentations 37 can be formed on the inside and/or in the end face regions of the shaft 20 and on correspondingly allocated surface regions of the carrier device 5. The said almost double-sided projections 36 and indentations 37 can thereby produce improved locking or positioning for the carrier device 5 with the stamp pad 4 relative to the holding fixture 23 or its shaft 20.

Mainly, if the carrier device 5 can be used or removed with the stamp pad 4 solely from one side or wall surface 21 or 22 in the shaft 20, it is sufficient to arrange only one locking indentation on the carrier device 5 and in the shaft 20 or only one locking projection, which cooperates with two mutually spaced apart locking or stop elements 29, 30 in the form of projections 36 and/or indentations 37.

Between the individually predefined positions of the stamp pad 4, in particular between the position or work or use 33 and the replacement or maintenance position 34, the carrier device 5 with the stamp pad 4 can be adjusted relative to the shaft 20 even free-slidingly. Instead of the design having its own locking or stop elements 30 in the replacement or maintenance position 34 it is of course also possible within the scope of the invention to provide only one stop delimitation that can be overcome by additional force, if necessary. Said stop delimitation is designed in such a way that it is not possible for the carrier device 5 with the stamp pad 4 to fall out of the shaft 20 when the carrier device 5 is moved out of the position of work or use 33. In the following the carrier device 5 with the stamp pad 4 can be slid back and forth freely in a section between the position of work or use 33 and the replacement or maintenance position 34. The additional locking or stop element 30 or the further holding device 32 in and end part of the shaft 20 or in and end part of the carrier device 5 prevents the carrier device 5 from falling out completely.

At least one of the locking or stop elements 29, 30 is designed in such a way that a kind of stop coupling is formed, which can create sufficient holding force that the carrier device 5 can be secured at least in the position of work or use 33, and by applying a pressure force, for example via a finger of the user or a separate operating element, moves relative to the shaft 20 and can be moved into the replacement or maintenance position 34. The elastic flexible and restoring movement of the locking or stop elements 29, 30 can thus be converted by the elastic properties of the projections 36 or indentations 37 themselves or by means of elastic flexible and restoring projections 36 and indentations 37, for example on spring mounted tongues.

Figure 4:
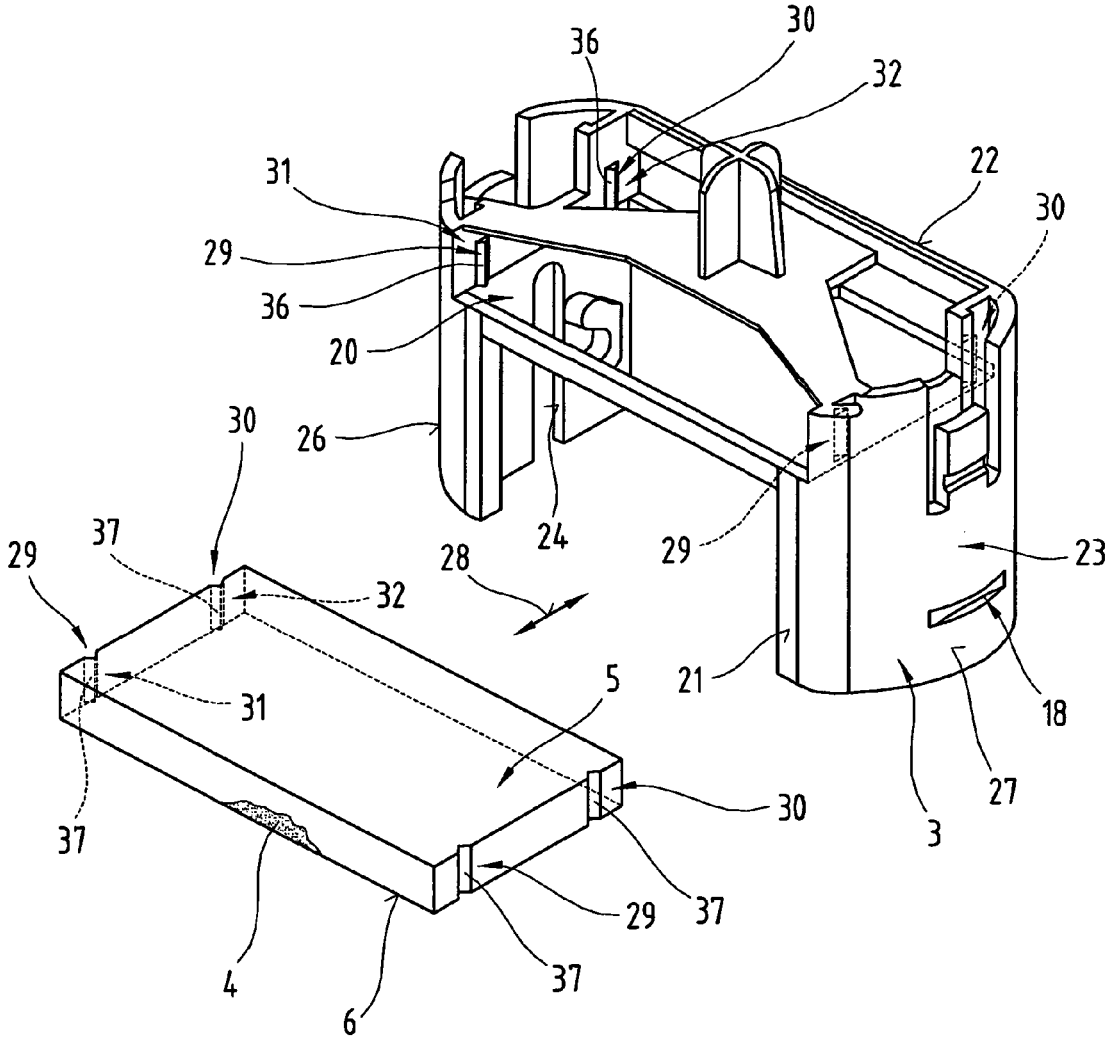
FIG. 4 shows a further design variation of a holding fixture according to the invention for the stamp pad of a stamp with mutually spaced apart holding devices for the stamp pad in simplified perspective view.

In FIG. 4 a different design and arrangement is shown of a holding fixture 23 or a lower part 3 for a stamp designed according to the invention with spaced apart holding devices 31, 32 or locking or stop elements 29, 30 on a carrier device 5 of a stamp pad 4 and/or on or in a shaft 20 for replaceably mounting a cuboid carrier device 5. For reasons of simplicity only the lower part 3 and the holding fixture 23 of a stamp designed according to the invention is shown.

Hereby in the end parts or side wall areas of the cuboid carrier body 5 two spaced part locking or stop elements 29, 30 designed as indentations 37 are formed in insertion or removal direction—according to arrow 28. Said locking or stop elements 29 and 30 are in the inserted position or in the work position of the carrier device 5 in positive connection with corresponding locking or stop elements 29 and 30, by applying correspondingly high pressure forces in detachable connection. In this way on side delimitation surfaces of the shaft 20 locking or stop elements 29, 30 in the form of locking noses are provided, and at the end, opposite end regions of the carrier device 5 the corresponding locking indentations are formed. Of course, the opposite or inverse arrangement of the locking indentations or locking projections is also possible.

It is also conceivable to provide only one locking or stop element 29 or 30 either on the carrier device 5 or in or about the shaft 20, which depending on being in the replacement or maintenance position is optionally in connection with one of the two mutually spaced locking or stop elements 29, 30.

The uncoupling or disconnection of the locking connection between a projection 36 and an indentation 37 or a differently designed coupling device can be achieved by the elastic flexibility of the material of the locking or stop elements 29, 30 themselves, in particular by its elasticity, or also by locking or stop elements 29, 30 mounted adjustably relative to the holding fixture 23 or relative to the carrier body 5. For the relative adjustment of a locking or stop element 29, 30 in particular a wart-like elevation or a projection 36 it is possible to provide slot-like openings in the plastic material in its peripheral region which permit spring mounting of the projections 36 in transverse direction to the insertion or removal direction—according to arrow 28. The projections 36 are thus arranged on spring-elastically mounted locking or holding tongues for the carrier device 5. It is also possible to make wall areas, on which the projections 36 or indentations 37 are arranged, elastically flexible and thus achieve a specific prestressing for an optionally activatable and deactivatable locking.

In the embodiment shown it is advantageous that the carrier device 5 with the stamp pad 4 can be inserted into the shaft 20 or removed from the shaft if necessary from both sides or wall surfaces 21, 22. The carrier device 5 with the stamp pad 4 is accessible from both sides of the stamp. This is achieved on the one hand in that the shaft 20 is designed as an opening with a cross section that stays essentially the same over the length and depth of the shaft 20.

Figure 5:
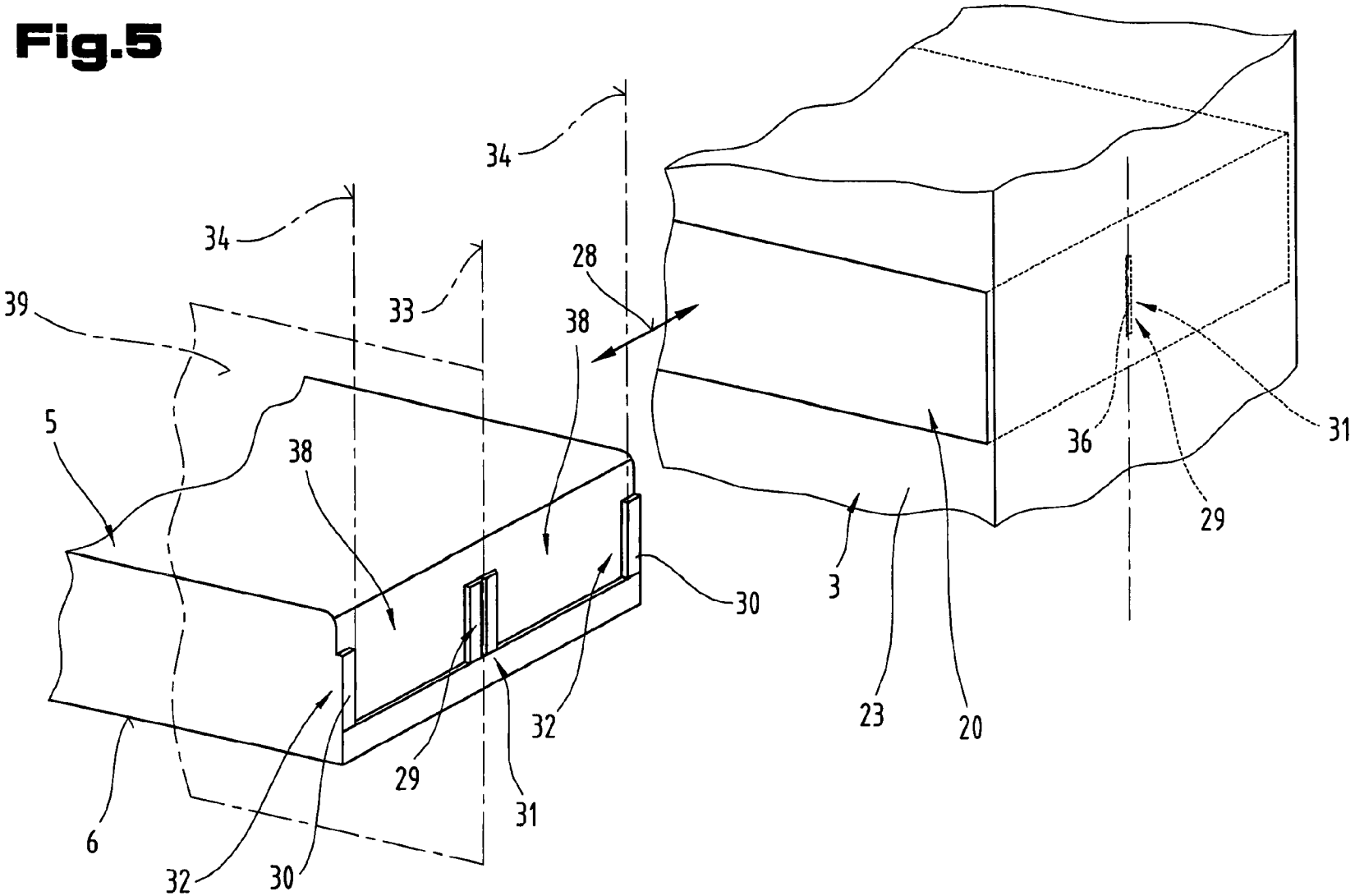
FIG. 5 shows a partial section of an embodiment of a carrier device for a stamp pad with mutually spaced apart holding devices as a component for a stamp according to the invention in simplified, perspective view.

In FIG. 5 a different design is shown for the construction of a snap or locking connection and for the end stop of a carrier device 5 relative to a mounting shaft in a stamp. In this case on opposite side walls of the carrier device 5 for the stamp pad a locking or stop element 29 is arranged, which position the carrier device 5 in the position of work and with specific holding force secure it in the corresponding holding shaft. Said locking or stop elements 29 are hereby arranged in the middle part of the side walls or end faces of the dome-like carrier device 5. In an end or edge part of said side or face walls of the carrier device 5 spaced apart therefrom a locking or stop element 30 designed as an end stop is arranged respectively. Said locking or stop element 30 prevents the complete removal of the carrier device 5 with the stamp pad 4 from the associated holding shaft. Only by applying a sufficiently high pulling force can the carrier device 5 be removed, preferably completely from the stamp or the respective lower part.

Hereby, in particular by means of a special design of the outer, side wall surfaces of the pad holder or the carrier device 5, the carrier device 5 can be secured or positioned at least in the working position of the stamp pad 4. By means of pressure on the carrier device 5 or the pad holder from the front the latter can be forced to move past the locking noses formed on the housing or the insertion shaft. Said uncoupling and coupling procedure can be made easier or assisted by inclined surfaces on the locking nose or locking indentations. Locking noses and locking indentations assigned to one another on the carrier device 5 or inside the holding shaft are preferably elastically biased relative to one another, in order to achieve a position or mounting that is as playfree and secure as possible. The carrier device 5 with the stamp pad is prevented from completely falling out in that in at least one end part of at least one side wall a step-shaped projecting locking or stop element 30 is provided.

In order to obtain as far as possible free mobility of the carrier device 5 in a section between two spaced apart holding devices 31, 32 without any resistance, clearances 38 or corresponding cut outs in the material can be made. Clearances 38 of this kind are preferably provided between two mutually spaced apart locking or stop elements 29, 30. Said clearances 38 can thus be formed on the side walls of the carrier device 5 and ensure that for example locking noses or projections 36 on an inner surface delimiting the shaft 20 do not come into contact or frictional grip or only slightly with the carrier device 5. Also with the reverse arrangement of the projections 36 and indentations 37 between the carrier device 5 and the holding fixture 23 or the shaft 20 clearances 38 of this kind can be formed.

As can also be seen from FIG. 5, several, in particular three, spaced apart holding devices 31, 32 or locking or stop elements 29, 30 can be formed distributed in the removal or insertion direction—according to arrow 28. In particular in this case in the corner or edge parts of the carrier device 5 two locking or stop elements 30 acting as an end stop are provided. In the middle section between the two locking or stop elements 30 the further locking or stop element 29 is arranged which secures or positions the carrier device 5 in its position of work or use 33. Thus in this embodiment there are basically two replacement or maintenance positions 34 and a defined position of work or use 33 for the carrier device 5 and the stamp pad 4.

Preferably, the carrier device 5 is designed be to symmetrical to its longitudinal plane of symmetry 39. That is the locking or stop elements 30 acting as end stops arranged in the edge or corner parts of the cuboid carrier device 5 are placed at the same distance to the central locking or stop element 29 which defines the position of work or use 33 of the carrier device 5.

Alternative arrangements and/or positions of the locking or stop elements 29, 30, or that of the holding devices 31, 32 for ensuring a defined working position and for ensuring that the carrier device 5 after leaving the secured position of work or use 33 cannot fall out of the holding shaft, can be defined by an expert in the field. Moreover, a series of modifications are possible without departing from the scope of the invention.

Figure 6:
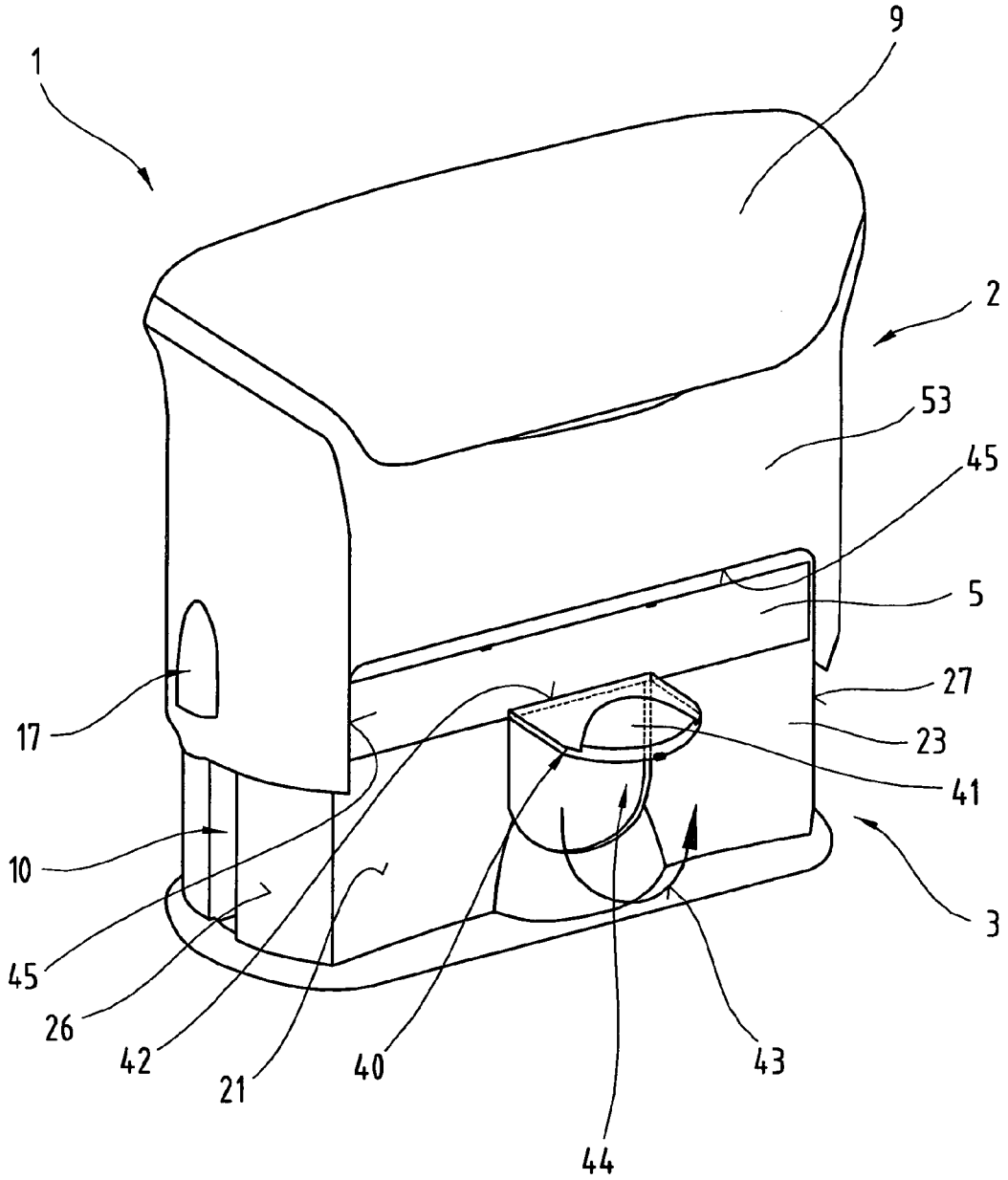
FIG. 6 shows a stamp with a grip for easy removal or relative adjustment of the stamp pad in a simplified, perspective view.
Figure 7:
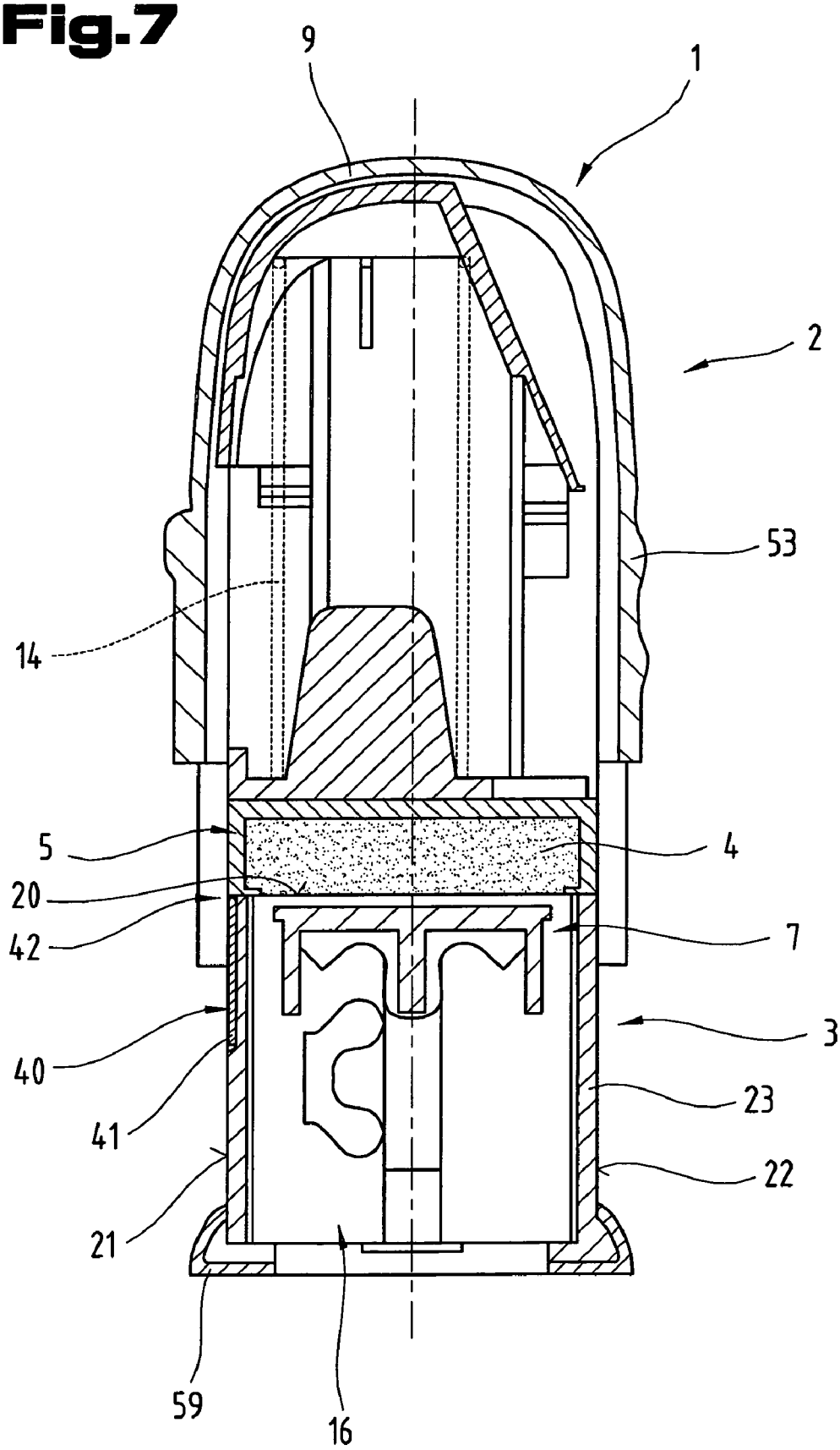
FIG. 7 shows a stamp with a grip for easy removal or relative adjustment of the stamp pad in simplified, schematic cross section.
Figure 8:
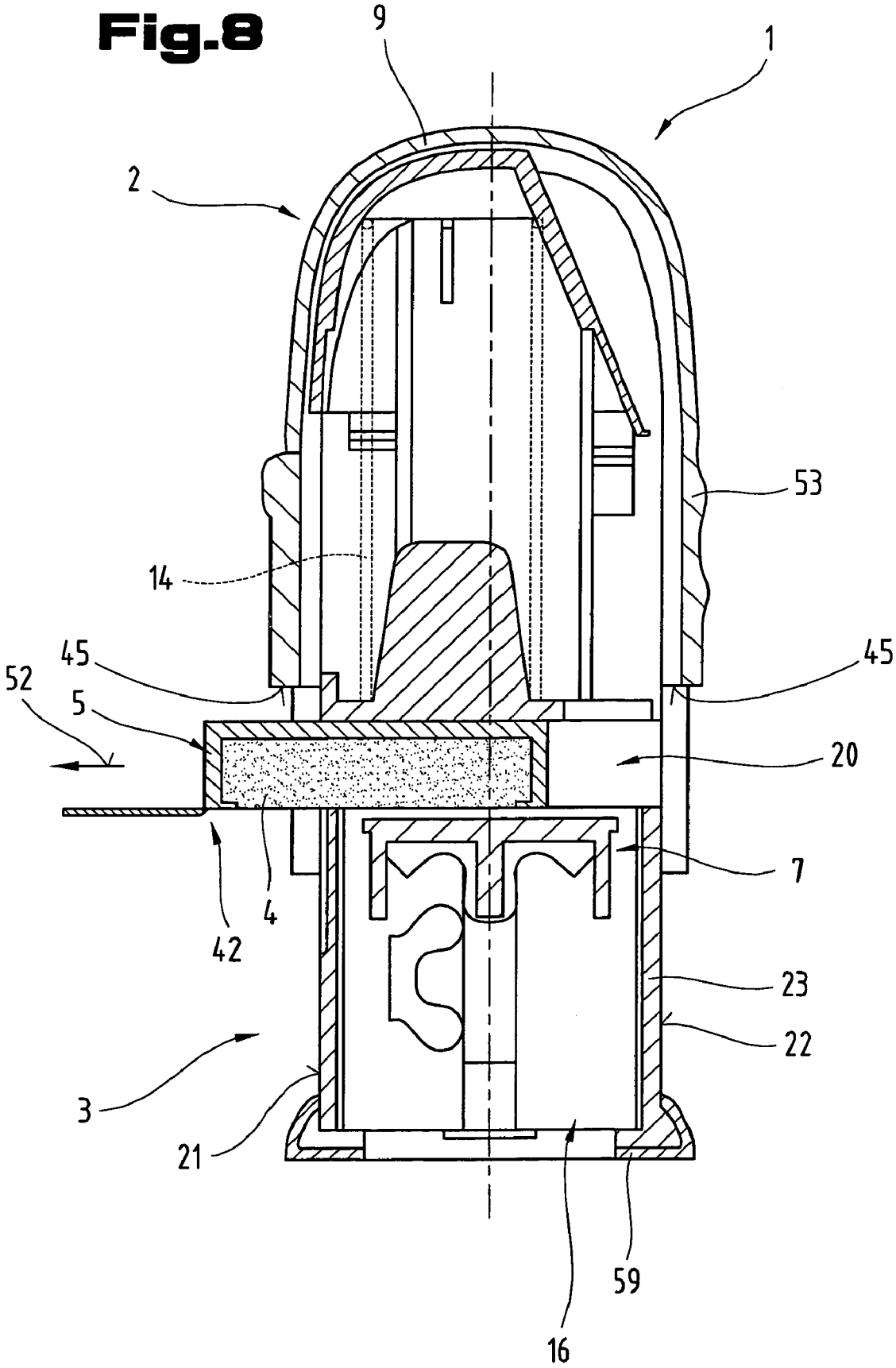
FIG. 8 shows the stamp according to FIG. 7 with the stamp pad partly drawn out using the grip.

In FIGS. 6 to 8 an independent design of the invention or an optional, advantageous development of the previously described stamp 1 is illustrated.

The structure of this stamp 1 corresponds essentially to the one in the preceding description and the same reference numbers are therefore used for the same parts. Previous descriptions can therefore be transferred analogously to the same parts with the same reference numbers.

In particular, in this design a lower part 3 to be placed onto the material to be stamped is provided, the upper edges of which are surrounded at least partially by a cap or dome-like upper part 2. The upper part 2 which at the same time forms or comprises the operating element 9 for the stamp 1 is thus adjustable against the effect of force of the spring 14 relative to the lower part 3. By means of a telescopic insertion of the upper part 2 into the lower part 3 the printing plate carrier 8 of the stamp pad 4 is moved in the direction of the material to be stamped and thereby the desired stamp is produced on the material.

Also in this case the soft elastic stamp pad 4 is mounted in a relatively stable shaped carrier device 5. The carrier device 5 with the ink-soaked stamp pad 4 mounted therein is insertable into the correspondingly dimensioned shaft 20 of the stamp 1 and if necessary can be replaced or refilled by a user for example, for maintenance purposes. Here the carrier device 5 with the stamp pad 4 has to be removed at least partially out of the shaft 20 in order to make the stamp pad 4 accessible.

In order to facilitate the handling of the stamp 1 for control or replacement purposes at least one adjustably mounted grip 40 is formed on the carrier device 5 of the stamp pad 4.

According to a preferred embodiment said grip 40 is designed in the form of a tab 41 which is pivot-connected with the carrier device 5, and can be adjusted or pivoted between a position of rest—FIG. 7—and a working position—FIG. 6 or FIG. 8. The preferably pivoting or hinge-like connection between the grip 40 and the frame-like carrier device 5 for the stamp pad 4 is preferably performed by means of a so-called film hinge 42. A film hinge 42 of this kind is made by a relatively thin-walled material link between the tab 41 or the corresponding grip 40 and the actual carrier device 5. The grip 40 is thereby joined to the carrier device 5 in one piece and this one-piece design with the film hinge 42 in between is preferably made in an injection moulding procedure. If necessary the plastic from which the carrier device 5 and the grip 40 are made is compressed in the region of the film hinge 42 in order to obtain a high degree of strength for the film hinge 42 and as far as possible a stable connection between the tab-like grip 40 and the carrier device 5.

Preferably, the grip 40 can be lifted up according to arrow 43 in order to move the grip 40 from a position of rest into the work or active position. It is advantageous here that a carelessly positioned grip 40 cannot hinder the stamping process as by pressing down the upper part 2 a grip in the active or working position is necessarily pivoted into the position of rest or closer to the position of rest. It is also favourable to position the grip 40 or tab 41 in the lower edge region of the cuboid carrier device 5.

If necessary the tab-like grip 40 is secured in its position of rest—FIG. 7—by a locking or fixing device not shown in more detail. As can best be seen from FIG. 6 in the lower part 3 a grip hollow 44 can also be designed in the lower part 3 which facilitates the gripping of the tab 41 or the moving of the latter from the position of rest into the active or working position.

In the active or working position of the grip 40—FIG. 6—the removal of the carrier device 5 with the stamp pad 4 is made easier as there is a greater gripping or holding surface and the action of force can be optimised. Said grip 40 is in this case provided as a pulling or drawing member for the carrier device 5 relative to the shaft 20 or the mounting device 23. Of course it is also possible to press the stamp pad 4 or the carrier device 5 via said grip 40 out of the stamp and thus use the grip 40 as a pushing member.

It is advantageous to secure the tab 41 or the corresponding grip 40 after use in the position or rest or in the grip hollow by means of not shown fixing and locking devices and thereby prevent the unwanted pivoting or adjustment of the latter.

Instead of the design of a tab 41 pivotable about a horizontal axis it is of course also possible to mount the grip pivotally about a vertically aligned axis. Preferably, a film hinge is always provided in order to achieve an economical manufacture of the carrier device 5 and/or stamp pad 4.

As an alternative to forming a grip 40 it also conceivable to form grip hollows or pulling slots in the wall parts of the carrier device 5. However, in certain circumstances the space available for the stamp pad 4 is slightly reduced by this and also handling is worse compared to a pivoting or folding grip 40. The formation of at least one grip 40 or tab 41 injected onto the carrier device 5 is particularly advantageous with respect to handling when replacing or examining the stamp pad 4. The connection of the grip 40 to the carrier device 5 via the film hinge 42 permits economical manufacture and relatively unproblematic production.

In the embodiment according to FIGS. 6 to 8 the lower edge of the upper part 2 or the operating element 9 is set back or recessed in the region of the front and back of the stamp 1 in order to permit the insertion and removal of the carrier device 5 relative to the shaft 20 when the stamp is in the position of rest shown in FIGS. 6 to 8. In the region of the narrow sides 26, 27 of the stamp 1 however the upper part 2 or the operating element 9 extends underneath the lower edge of the shaft 20. In this way the holding surface area is as large as possible and ergonomic operation of the stamp 1 is achieved. Said recesses 45 or cutouts in the lower edge region of the upper part 2 or operating element 9 are sized so that the carrier device 5 can be inserted into the shaft 20 without difficulty or can be removed therefrom, when the stamp 1 is in start position or a position of rest or by means of the securing device 17 is in the maintenance or securing position defined for the replacement of the pad.

Figure 10:
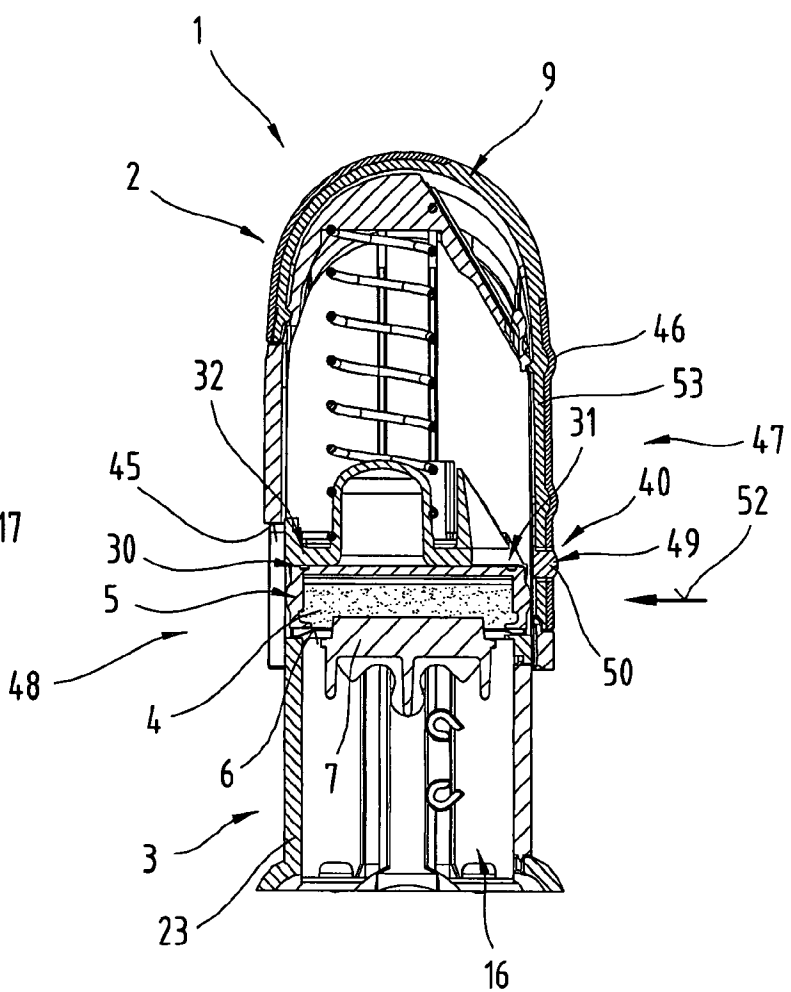
FIG. 10 shows the stamp according to FIG. 9 in cross section along the lines X—X of FIG. 9.
Figure 9:
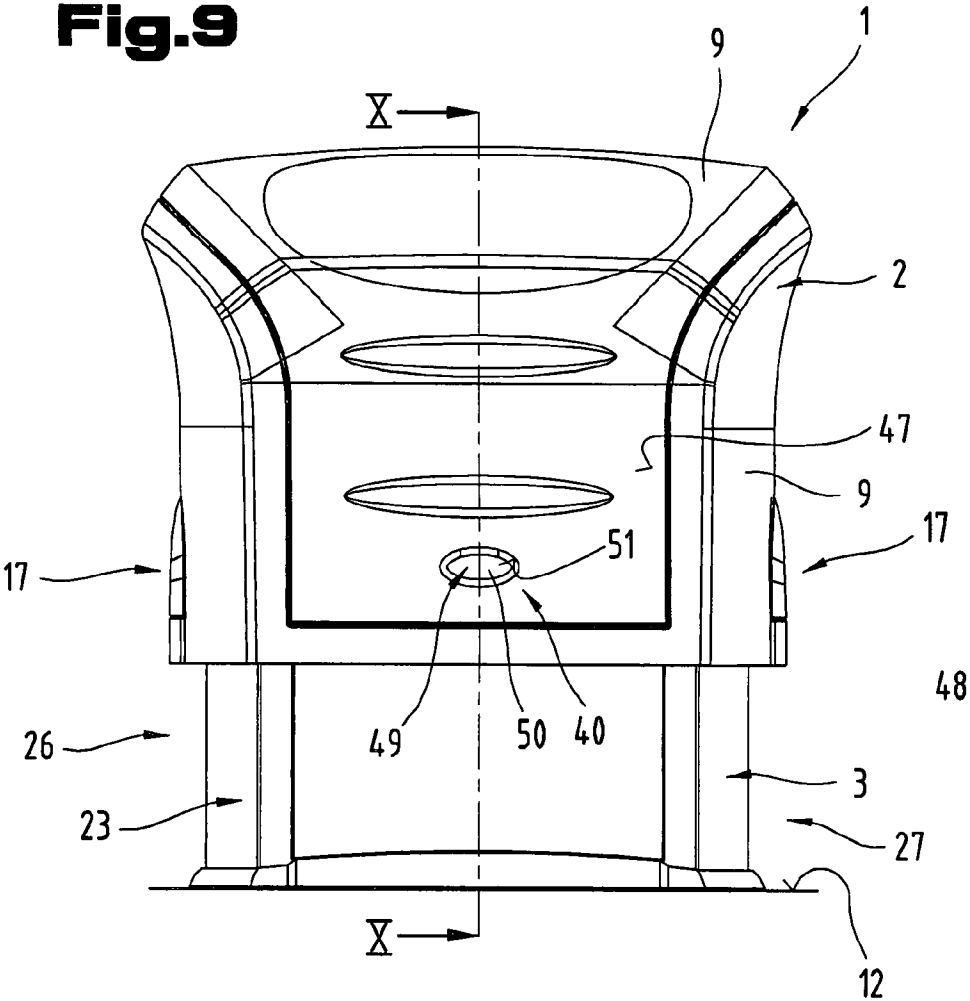
FIG. 9 shows a different, independent embodiment of a stamp with a grip for changing the stamp pad in frontal view.

In FIGS. 9 and 10 a further, independent embodiment of the invention is shown for improving the replacement or examination of a used stamp pad 4. In this case in contrast to the detachment of the tab described above which is mainly used as a pulling means, a press out disconnection of the stamp pad 4 with the carrier device 5 from a corresponding holding shaft of the stamp 20 is proposed.

The basic structure of the stamp 1 corresponds in this case to the previously described structure so that the preceding descriptions can be applied to the same parts with the same reference numbers.

Here the upper part 2 or the operating element 9 or another element of the upper part 3, such as for example a see-through window, a text window, a rubber grip section 46 or the like, is pulled on the front side 47 of the stamp 1 via the carrier device 5 and the stamp pad 4, so that the latter is overlapped or covered at least partially by the upper part 2. In particular, a lower edge of the dome or cap-like upper part 2 or operating element 9 extends under the bottom side 6 of the stamp pad 4 or its carrier device 5. The upper part 2 or the operating element 9 for the stamp 1 thus extends relatively far in the direction of the standing surface 12 of the stamp 1 so that there can be a relatively large and thus ergonomic gripping part or operating area. On the back 48 of the stamp 1 a recess 45 or a cut-out is formed in the cap shaped upper part 2 in order to remove the stamp pad 4 as required from the shaft 20 without being hindered by the cap-shaped upper part 2.

On the front side 47 of the stamp 1, in particular in the cap-shaped upper part 2 of the stamp 1 on its front side a grip 40 designed as a pusher element 49 is formed for pushing out or removing the carrier device 5. Said pusher element 49 can be designed in the form of an independent push button 50 which is inserted in a corresponding recess 51 of the upper part 2 or the operating element 9 in such as way that the push button 50 can be moved relative to the peripheral edge parts of the cap-shaped upper part. In particular, with the effect of pressure on the pusher element 49 the latter is adjustable parallel to the guiding track of the shaft 20 or parallel to the push out direction—according to arrow 52—of the carrier device 5 relative to the shaft 20. Instead of a direct application of force on the carrier device 5 there is also an indirect transfer of force, in particular transfer of pressure, onto the carrier device 5 for the stamp pad 4.

In order to eject the carrier device 5 from the shaft 20 at least slightly, the grip 40 designed as a push button 50 is moved to overlap the carrier device 5. For this the operating element 9 is moved slightly in the direction of the standing surface 12 and either stopped manually or via the securing device 17. By means of pressure from the front on the pusher element 49 or the push button 50 the latter is moved in the direction of the guiding track in the shaft 20, and the carrier device 5 is pushed out or ejected at least slightly out of the holding fixture 23 or out of the lower part 3.

To avoid the complete removal of the stamp pad 4 or the carrier device 5 from the shaft 20 the holding device 32 described above can be designed in the form of locking or stop elements 30.

Provided the push button 50 is designed as an independent component the latter is secured for example by means of a flexible tongue inside the recess 51, and is adjustable relative to the depth of the recess 51 in the operating element 9 or upper part 2.

Figure 11:
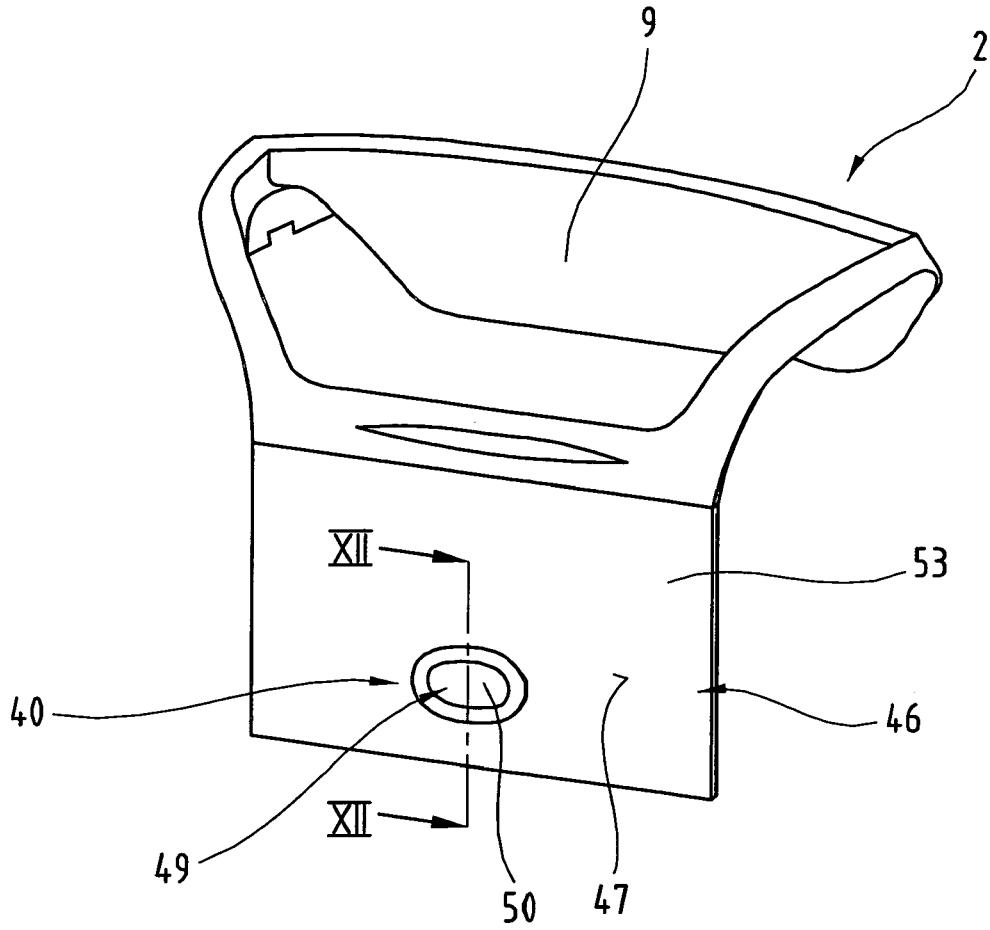
FIG. 11 shows a stamp component with a different design of grip for exchanging the stamp pad in simplified, perspective view.
Figure 12:
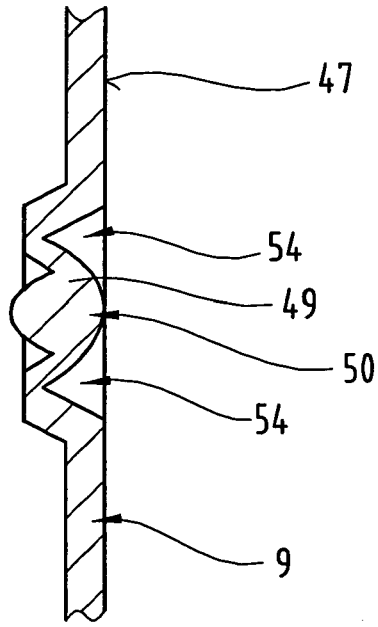
FIG. 12 shows the stamp component according to FIG. 11 designed as a cover or operating element in cross section along the lines XII—XII of FIG. 11.

As can be seen in FIGS. 11 and 12 the grip 40 designed as a pusher element 49 for the necessary removal or slight pushing out of the stamp pad 4 out of the holding shaft can also be formed by an element designed in one piece with the upper part 3 or the operating element 9 or a stamp cover 53. In particular, in this case by means of the elastically flexible properties of the stamp cover 53 or the upper part 2 a partial region which is to form the grip 40 or the push button 50 is designed to be elastically flexible and self-restoring. The latter can for example be achieved by means of a domed push button 40 which is surrounded by a bead 54. It is advantageous in this case that no independent element is required for the grip 40 and in the manufacturing process, in particular in an injection moulding process, a push button 50 of this kind can be produced efficiently.

Particularly, when the stamp cover 53 or the coating for the stamp is made from an elastomer plastic the stamp cover 53 can be used with the integral push button 50 as a grip 40 for ejecting the stamp pad. At the same time its handling is improved by means of the elastomer, e.g. rubber-like, gripping area of the stamp.

Figure 13:
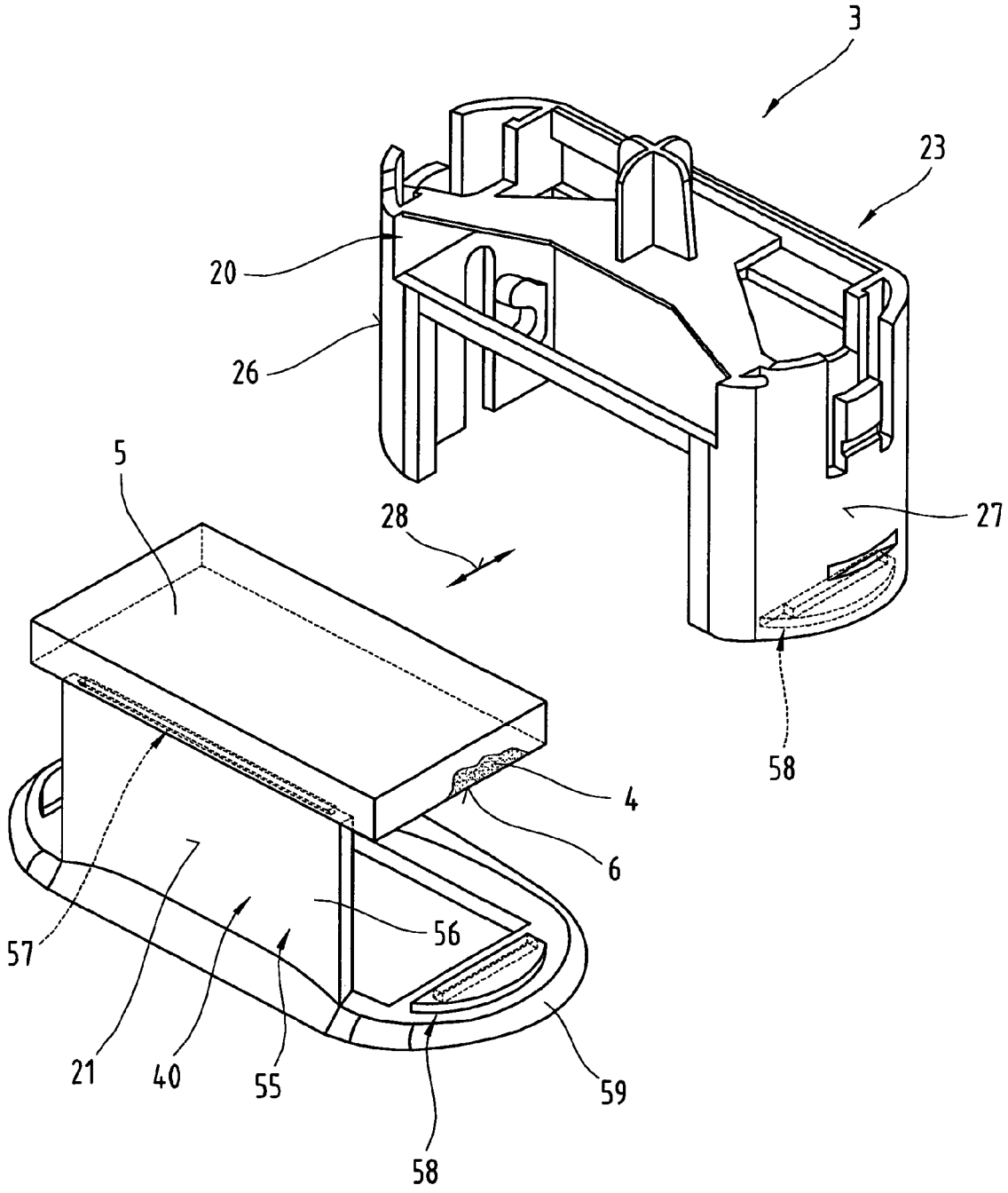
FIG. 13 shows a further embodiment of a holding fixture according to the invention for a stamp pad of a stamp with an extended grip for improved handling of the stamp pad in simplified, perspective view.
Figure 14:
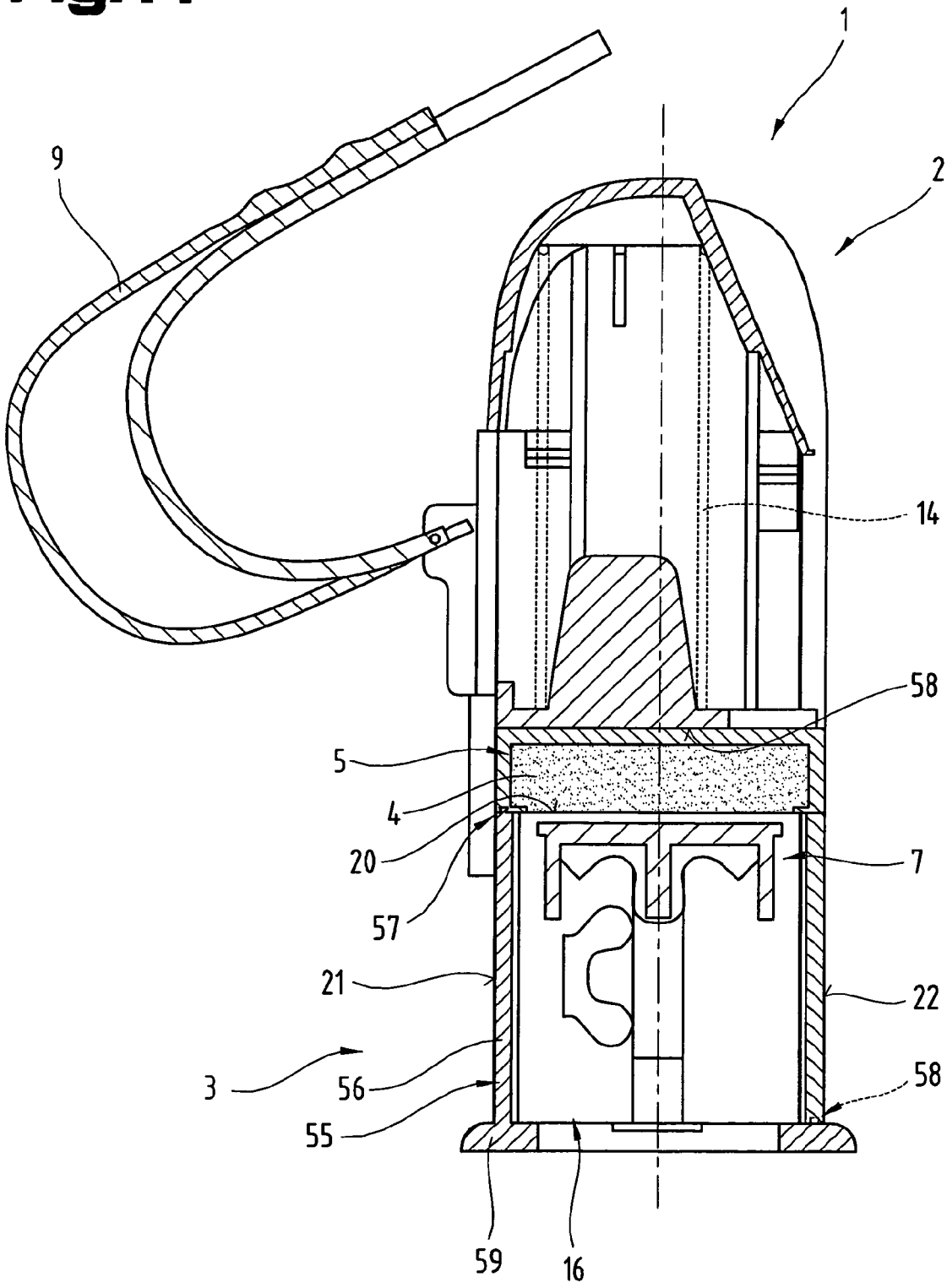
FIG. 14 shows a stamp in cross section in which the holding fixture is used according to FIG. 13.
Figure 15:
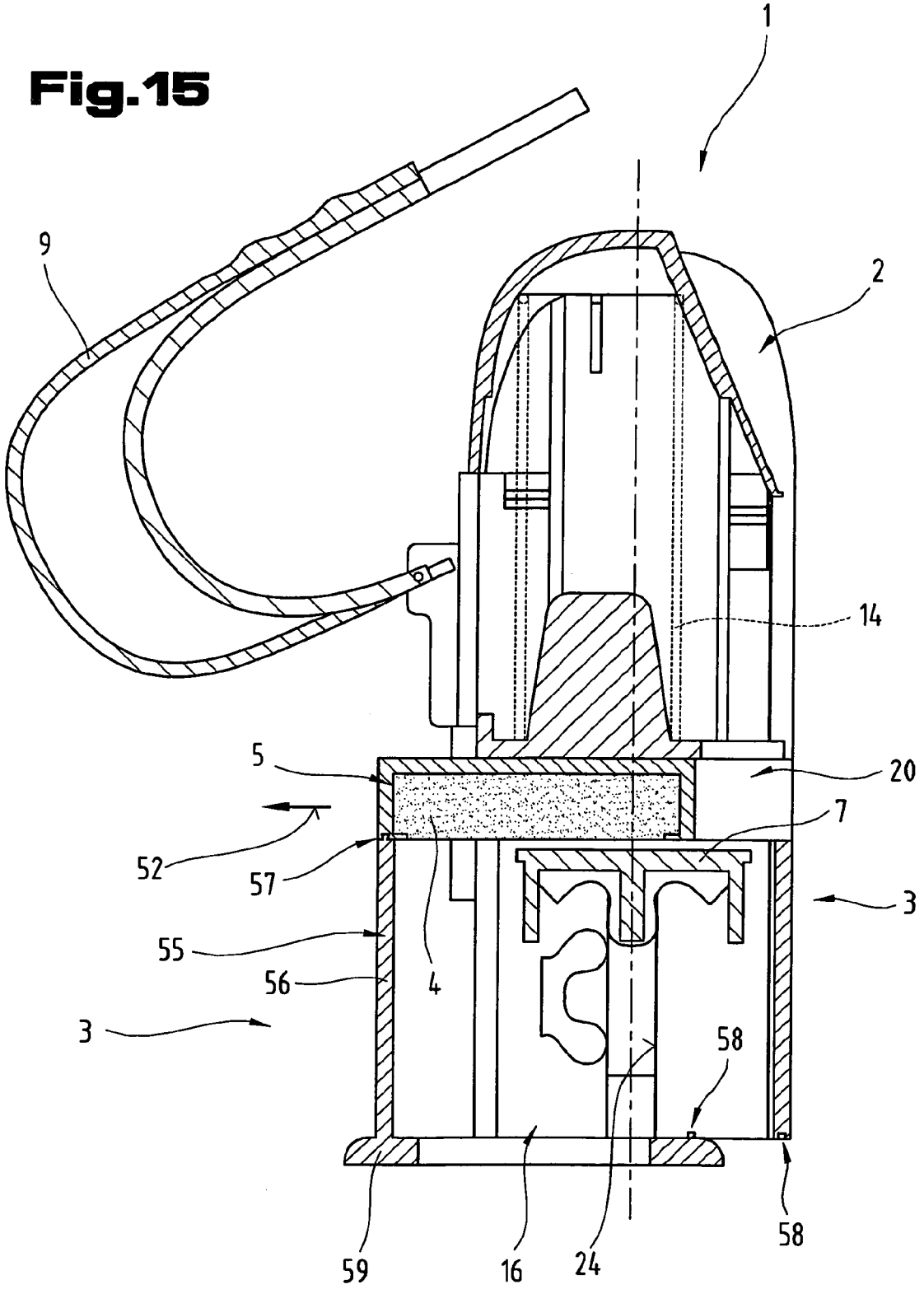
FIG. 15 shows the stamp according to FIG. 14 with a stamp pad partially removed from the holding shaft together with the associated stamp component as an extended grip in simplified, schematic cross section.

In FIGS. 13 to 15 an independent embodiment according to the invention is illustrated for improving the control or replacement process of the stamp pad 4 of a stamp 1 relative to the holding fixture 23 for the carrier device 5 of a stamp pad 4.

In this case the carrier device 5 is secured to a component 55, in particular a wall part 56 of the stamp 1 or the holding fixture 23. It can be secured either detachably, for example by means of the schematically indicated coupling device 57 or undetachably by means of a one-piece design of the carrier device 5 and wall part 56.

The respective component 55 of the stamp 1 takes up relatively large areas of the outer surfaces of the stamp 1 in comparison to the side surfaces of the essentially cuboid carrier device 5. In particular, the component 55 or the wall part 56 should have a relatively wide grip 40 that is easy and safe to handle for the simplified manipulation of the stamp 1 when removing or inserting the stamp pad 4 in the shaft 20. The component 55 or wall part 56 is thus almost an extended grip 40 for the carrier device 5 and/or the stamp pad 4.

Preferably, the component 55 can be coupled or connected to the holding fixture 23 by means of guide and/or fixing elements 58 and if necessary detached therefrom. Said guiding and/or fixing elements 58 can also be in the form of any locking or snap connections known from the prior art on the component 55 and corresponding or interacting connecting elements on the holding fixture 23 or on the stamp housing.

Alternatively, or in combination therewith it is also possible, with reference to the previously described, positively engaged holding devices 31, 32—cf. for example FIGS. 1 to 3—to achieve the desired positioning and mounting of the carrier device 5 together with the component 55 relative to the mounting frame 23 on the carrier device 5 and on the stamp housing. The component 55 of the stamp 1 connected to the carrier device 5, or the holding fixture 23 can for example be one of the outer wall surfaces 21 of the holding fixture 23 or of the corresponding stamp 1. If necessary, the component 55 can also comprise a so-called mounting frame 59, by means of which the stamp 1 is placed onto the material to be stamped.

Preferably, the component 55 projects essentially at right angles to the lower side 6 of the block-shaped carrier device 5 and the block-shaped stamp pad 4. Said component 55 thus engages flush with one of the side faces of the almost cuboid carrier device 5, so that an essentially L-shaped cross-sectional stamp component is produced.

In addition, with this embodiment also the afore-described locking or stop elements 29, 30—cf. FIGS. 1 to 3—can be used for the secure positioning or end delimitation of the displacement movement of the carrier device 5 together with the component 55 relative to the holding fixture 23.

An advantage of this design is that the stamp pad 4 or its carrier device 5 need not be handled by the operator at close proximity, but a there is a kind of extended grip 40 that can be held securely and connected rigidly and immobily to the carrier device 5, by means of which the risk of fingers or clothes getting dirty is minimised when the stamp pad 4 is in use. It is also made possible in this way to improve the holdability of the sometimes relatively small stamp pad 4 and even with relatively clumsy handling safely remove or easily insert the stamp pad 4 into the holding fixture 23.

By designing a coupling device 57 it is possible during a necessary replacement of the stamp pad 4 to either replace the carrier device 5 together with the stamp pad 4 and the component 55 or just to dispose of the carrier device 5 with the stamp pad 4. The latter is recommended especially when the component 55 has a relatively large surface area and is expensive. For cases of this kind the coupling device 57 is put between the carrier device 5 and the component 55, which coupling device can preferably be a kind of tool-free, locking or positively engaging connection between said parts, as shown mainly in FIGS. 14, 15. For example, the coupling device 57 can be in the form of a dovetail connection.

Figure 16:
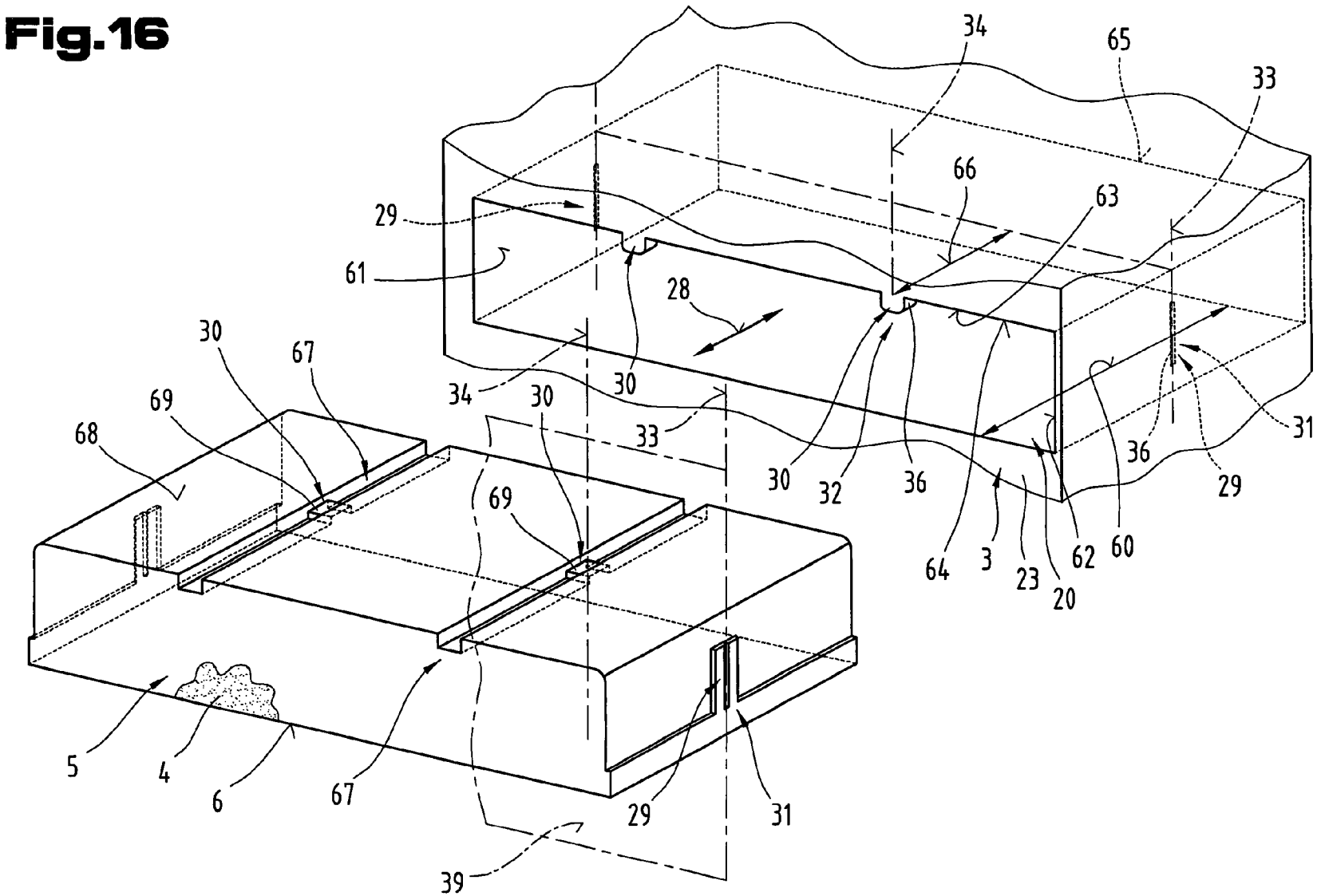
FIG. 16 shows a modification of the embodiment according to FIG. 5 in particular a carrier device for a stamp pad with mutually spaced apart holding devices as a component of a stamp according to the invention in simplified perspective view.

In FIG. 16 a slightly different design of the embodiment according to claim 5 is illustrated.

In this case the first locking or stop element 29 of the holding device 31 is arranged to securely mount the carrier device 5 mounting a stamp pad 4 in the position of work or use 33 in a middle section of a whole guide length 60 of the shaft 20. That is the locking or stop elements 29 are placed approximately in the middle section of the overall depth of the shaft 20. Preferably, two locking or stop elements 20 are provided on opposite, side inner surfaces 61, 62 of the shaft 20.

The additional holding device 32 spaced apart therefore, in particular its locking or stop elements 30, are here arranged on the upper inner surface 63, i.e. on the upper delimitation surface of the shaft 20, and are thereby provided at at least one face end part 64, 65 of the shaft 20. Said locking or stop elements 30 for defining the replacement or maintenance position 34 for the carrier device 5 are preferably in the form of wart-like projections 36, which project into the shaft 20 provided for mounting the carrier device 5. With reference the entire guide length 60 of the shaft 20 the further locking or stop elements 30 are spaced apart from the first or central locking or stop elements 29 by a distance 66 which corresponds to about half the guide length 60.

Said additional wart-like locking stop elements 30 project into at least one, preferably into two guide grooves 67 formed on an upper side 68 of the carrier device 5. Said groove-like guide grooves 67 extend over the entire depth of the carrier device 5 which corresponds roughly to the guide length 60 of the shaft 20. Approximately in the middle part of the said guide grooves 67 at least one wart-like elevation 69 is formed which in cooperation with the locking or stop elements 30 on the holding fixture 23 represents a delimitation stop for the carrier device 5 during the adjustment from the position of work or use 33 into the replacement or maintenance position 34 projecting out relative to the holding fixture 23 or the shaft 20.

That is in this embodiment the locking or stop elements 29 and 30 of the box-like or dome-like carrier device 5 for the stamp pad 4 are in the longitudinal plane of symmetry 39 of the carrier device 5. Instead of the pairwise arrangement it is of course also possible to provide only one locking or stop element 29, 30 or a large number of corresponding locking or stop elements 29, 30. Furthermore, it is also conceivable to move the locking or stop elements 29 placed on the side inner surfaces 61, 62 of the shaft 20 onto the upper inner surface 63 of the shaft 20.

With the described design it is achieved that the carrier device 5 with the stamp pad 4 is held exactly and reliably in the position of work or use 33 and thereby the carrier device 5 engages as far as possible flush with the outer surfaces of the holding fixture 23. For the replacement or maintenance of the stamp pad 5 it is merely sufficient to exert sufficiently high pressure on a free side surface of the carrier device 5 so that the latter exits roughly by half the guide length 60 or by the distance 66 out of the holding fixture 23 or its shaft 20. In this partially removed position of the carrier device 5 relative to the holding fixture 23 the carrier device 5 is then prevented from falling out of the shaft 20 completely or unintentionally or due to carelessness, in that the additional holding device 32 with the locking or stop elements 30 is activated. In this partially removed positioned safe from falling out completely the carrier device can be held securely without touching the stamp pad. Only by applying a defined removal force, for example by the conscious, manual pulling or pushing of the carrier device 5 can the carrier device 5 be removed together with the ink-soaked stamp pad 4 completely and safely from the holding fixture.

Also with this embodiment the stamp pad 4 is prevented from falling out totally or by surprise, if for example in error or due to inattention the carrier device 5 in the shaft 20 is acted upon. In this embodiment in an advantageous manner the stamp pad 4 is prevented from sliding directly or completely out of the shaft 20, after overcoming the holding device 31 for securing in the position of work or use 33, and thereby onto the floor, onto the table or onto clothing and thereby prevented from causing stubborn stains.

The carrier device 5 for a stamp pad 4 full of stamp ink can, as illustrated schematically, be designed to be cuboid. Mainly depending on the print to be produced the carrier device 5 and the stamp pad 4 and/or the holding fixture 23 can in plan view also have round or polygonal, for example round, elliptical, triangular, polygonal contours or a combination of contours.

For form's sake it should be pointed out that for a better understanding of the structure of the holding fixture 23 or the stamp 1 its components are not always illustrated to scale and have been partly enlarged and/or reduced in size.

The objective of the independent solutions according to the invention can be taken from the description.

Mainly the individual designs shown in FIGS. 1 to 3; 4; 5; 6 to 8; 9 to 12; 13 to 15; 16 can form the subject of independent solutions of the invention. The objectives and solutions referring thereto can be taken from the detailed descriptions of the Figures.

LIST OF REFERENCE NUMBERS

1. Stamp
2. Upper part
3. Lower part
4. Stamp pad
5. Carrier device
6. Bottom side
7. Stamp plate
8. Printing plate carrier
9. Operating element
10. Guide arrangement
11. Guide arrangement
12. Standing surface
13. Turning and displacement mechanism
14. Spring
15. Arrow (operating device)
16. Channel
17. Securing device
18. Indentation
19. Elevation
20. Shaft
21. Wall surface
22. Wall surface
23. Holding fixture
24. Vertical guide
25. Axle stub
26. Narrow side
27. Narrow side
28. Arrow (direction removal or insertion)
29. Locking or stop element
30. Locking or stop element
31. Holding device
32. Holding device
33. Position of work or use
34. Replacement or maintenance position
35. Transverse plane
36. Projection
37. Indentation
38. Free point
39. Longitudinal plane of symmetry.
40. Grip
41. Tab
42. Film hinge
43. Arrow (lift up)
44. Grip hollow
45. Recess
46. Grip area
47. Front side
48. Rear side
49. Pusher element
50. Push button
51. Recess
52. Arrow (direction of ejection)
53. Stamp cover
54. Bead
55. Component
56. Wall part
57. Coupling device
58. Guiding and/or fixing element
59. Mounting frame
60. Guide length
61. Inner surface
62. Inner surface
63. Inner surface
64. End face region
65. End face region
66. Distance
67. Guide groove
68. Upper side
69. Elevation

The invention claimed is:

1. A device comprising a holding fixture (23) for a carrier device (5) of a stamp pad (4), a shaft (20) with an approximately rectangular cross section arranged in the holding fixture and the carrier device (5) for the stamp pad (4) being mounted therein so as to be movable out relative to shaft (20), and a holding device (31) which holds the carrier device (5) relative to a guide track of the shaft (20) in a position of work or use (33), wherein the carrier device (5) is arranged on an outer wall part (56) of a housing of the holding fixture (23) forming the shaft (20) and the outer wall part (56) is securable and adjustable relative to the housing by means of guiding or fixing elements (58).

2. Device according to claim 1, comprising a coupling device (57) between the carrier device (5) and the outer wall part (56) which can be operated without tools.

3. Device according to claim 1, wherein the outer wall part (56) projects essentially perpendicular to a lower side (6) of the carrier device (5), whereby the carrier device has approximately the form of a cuboid.

4. Stamp (1) of the self-inking type, comprising a lower part (3) to be exposed to a surface to be stamped, an upper part (2) adjustable against the restoring force of a spring (14) relative to the lower part (3), and a turning and displacement mechanism (13) movably coupled with the upper part (2) for a stamp plate (7) arranged in the lower part (2), in order to move the stamp plate back and forth under a forced turning and translatory movement between a stamp pad (4) and the surface to be stamped, wherein the lower part (3) is formed by the device according to claim 1.

5. Device comprising a holding fixture (23) for a carrier device (5) of a stamp pad (4), a shaft (20) with a rectangular cross section arranged in the holding fixture, and a holding device (31) arranged between two end face regions of the shaft (20), the shaft forming a guide track and mount for the carrier device (5) of the stamp pad (4) which can be inserted and removed therefrom, the holding device (31) positioning the carrier device (5) relative to the guide track of the shaft (20) in its position of work or use (33), further comprising at least one additional holding device (32) by means of which the carrier device (5) together with the stamp pad (4) can be held positioned in a replacement or maintenance position (34) distant from the position of work or use (33), or a pushing out movement of the carrier device can be delimited relative to the shaft (20), the additional holding device (32) being deactivated by applying increased adjusting forces on the carrier device (5), and the holding devices (31,32) being locking or stop elements (29, 30) spaced apart from one another in the direction of a guide length of the shaft (20) on inner surfaces of the shaft (20) or locking or stop elements in end face regions of the shaft or locking or stop elements on outer surfaces of the carrier device (5), at least one of the locking or stop elements (29, 30) being formed of plastic material and being elastically pliable and self-restoring due to properties inherent in the plastic material.

6. Device according to claim 5, wherein the locking or stop elements (29, 30) can be moved in and out of positive engagement relative to at least one corresponding projection (36) or indentation (37), or delimitation of a path of adjustment of the carrier device (5) relative to the shaft (20)can be lifted.

7. Device according to claim 5, wherein holding forces of the holding devices (31,32) can be lifted or deactivated without tools.

8. Device according to claim 5, wherein the carrier device (5) is a cuboid holding frame open at the bottom for a comparatively soft elastic stamp pad (4) charged with printer's ink or stamp ink.

9. Device according to claim 5, wherein a first one of the locking or stop elements (29, 30) is an indentation (37) to secure the position of work or use (33), and spaced apart therefrom there is at least a further one of the locking or stop elements (29, 30) in the form of a projection (36) to form an end stop, and in one section between the first and at least one further locking or stop element (29, 30) there is at least one clearance (38) so as not to interact or at least interact with reduced holding or frictional force with an allocated projection (36) on an inside of the shaft (20).

10. Device according to claim 9, wherein the first locking or stop element (29) for securing the position of work or use (33) is formed in a middle part of a guide length (60) of the shaft (20) and the further locking or stop element (30) spaced apart therefrom is designed to define the replacement or maintenance position (34) in at least one end face region (64, 65) of the shaft (20).

11. Device according to claim 10, comprising at least one further or end face locking or stop element (30) in the shaft (20), which is formed by at least one wart-like projection (36) engaging in at least one groove shaped guide groove (67) on an upper side (68) of the carrier device (5) for the stamp pad (4) insertable into the shaft (20).

12. Device according to claim 11, wherein in a middle section of the guide groove (67) on the carrier device (5) mountable by the shaft (20) there is at least one wart-like elevation (69), which in cooperation with the locking or stop element (30) on the shaft (20) forms a delimitation stop which can be overcome by manually pulling or pushing the carrier device (5) for a retracting movement of the carrier device (5) from the position of work or use (33) into the replacement or maintenance position (34) spaced apart therefrom.

13. Device according to claim 10, wherein two locking or stop elements (30) spaced apart from one another perpendicular to the guide length (60) of the shaft (20) are formed on an upper inner surface (63) of the shaft (20).

14. Device according to claim 4, wherein the locking or stop elements (29, 30) are formed respectively on opposite side faces or on an upper side of the carrier device (5).

15. Device according to claim 5, wherein the at least one of the locking or stop elements (29, 30) is elastically pliable and self-restoring by being formed on an elastically mounted tongue made of plastic.

16. Device according to claim 5, wherein the holding fixture is a hollow prismatic housing, which at one end forms the shaft (20) in which a perpendicular channel (16) is formed, in which a stamp plate (7) is arranged so as to be relatively movable.

17. Device according to claim 5, comprising an adjustably mounted grip (40) on the carrier device (5).

18. Device according to claim 17, wherein the grip (40) is connected pivotably to the carrier device by a film hinge (5).

19. Device according to claim 17, wherein the grip (40) can be adjusted between an active position, in which the effect of force on the carrier device (5) is facilitated, and an inactive position in which the carrier device (5) is locked or prevented from moving relative to the shaft (20).

20. Stamp (1) of the self-inking tape, comprising a lower part (2) to be exposed to a surface to be stamped, an upper part (2) adjustable against the restoring force of a spring (14) relative to the lower part (3), and a turning and displacement mechanism (13) movably coupled with the upper part (2) for a stamp plate (7) arranged in the lower part (2), in order to move the stamp plate back and forth under a forced turning and translatory movement between a stamp pad (4) and the surface to be stamped, wherein the lower part (3) is formed by the device according to claim 5.

21. A self-inking stamp (1), comprising a lower part (3) to be placed on a surface to be stamped, an upper part (2) which is displaceable relative to the lower part (3) against a restoring force of a spring (14), a turning and displacement mechanism (13) movably coupled with the upper part (2) for a stamp plate (7) arranged in the lower part (2), in order to move the lower part under forced turning and translatory movement between a stamp pad (4) and the surface to be stamped, the stamp pad (4) being mounted at least partially in a comparatively stable frame or cap-shaped carrier device (5) secured by a holding device (31) in a position of work or use (33), and a grip (40) on the carrier device (5) by which the carrier device (5) can be moved at least from the secured position of work or use (33) into a replacement or maintenance position (34) or at least into a position uncoupled from the holding device (31), the grip (40) on the carrier device (5) is adjustably mounted, and can be moved between a position of rest and an active or working position.

22. Stamp according to claim 21, wherein the grip (40) is hinge connected to the carrier device (5) via so-called film hinge (42).

23. Stamp according to claim 21, wherein in the active or working position of the grip (40) an effect of force on the carrier device (5) is facilitated and, in the position of rest of the grip (40), a relative mobility of the carrier device (5) is restricted or blocked relative to the stamp (1).

24. Stamp according to claim 21, wherein the grip (40) is a one-piece tab (41) formed on the carrier device (5), which can be pivoted up about a horizontal pivot axis into the active or working position.

25. Stamp according to claim 21, wherein the grip (40) is secured in its position of rest by a locking or snap device.

26. Stamp according to claim 21, wherein a lower edge region of the upper part (2) overlaps the carrier device (5) either on a front or back side (47, 48) and the grip (40) is formed on the upper part (2).

27. Stamp according to claim 21, wherein the grip (40) is a push button (50) in a recess (51) of the upper part (2) and is movably mounted in an insertion of removal direction of the carrier device (5).

28. Stamp according to claim 21, wherein the grip (40) is a pusher element (49) made in one piece with the upper part (2).

29. Stamp according to claim 28, wherein the pusher element (40) is an elastically flexible and self-restoring part in a section of the upper part (2) assigned to the carrier device (5).

30. Stamp according to claim 28, wherein the pusher element (49) is a bead-like indentation in the upper part (2) or in a stamp cover (53) secured to the upper part (2).

31. Stamp according to claim 28, wherein the pusher element (49) is formed by at least one slot-like opening in the section of the upper part (2) assigned to the carrier device (5).

32. Stamp according to claim 21, wherein the upper part (2) at least in a section assigned to the carrier device (5) is made from elastomer plastic.

33. Stamp according to claim 21, wherein the grip (40) is positioned ready for use relative to the carrier device (5) with an active securing device (17) or at a defined relative position between the upper part (2) and the lower part (3).

* * * * *